US006942323B2

(12) United States Patent
Nakamura

(10) Patent No.: US 6,942,323 B2
(45) Date of Patent: Sep. 13, 2005

(54) LIQUID DROPLET EJECTION APPARATUS, METHOD OF MANUFACTURING ELECTRO-OPTIC DEVICE, ELECTRO-OPTIC DEVICE, AND ELECTRONIC APPARATUS

(75) Inventor: Shinichi Nakamura, Okaya (JP)

(73) Assignee: Seiko Epson Corporation (JP)

( * ) Notice: Subject to any disclaimer, the term of this patent is extended or adjusted under 35 U.S.C. 154(b) by 160 days.

(21) Appl. No.: 10/675,867

(22) Filed: Sep. 30, 2003

(65) Prior Publication Data

US 2004/0125181 A1 Jul. 1, 2004

(30) Foreign Application Priority Data

Oct. 1, 2002 (JP) ..... 2002-288867
Aug. 21, 2003 (JP) ..... 2003-297221

(51) Int. Cl.[7] ..... B41J 2/175
(52) U.S. Cl. ..... 347/85
(58) Field of Search ..... 347/85, 86, 87

(56) References Cited

U.S. PATENT DOCUMENTS 6,170,937 B1 * 1/2001 Childers et al. ..... 347/85
6,338,553 B1 * 1/2002 Lewis et al. ..... 347/85

FOREIGN PATENT DOCUMENTS

JP 02000141698 A * 5/2000 ..... B41J/2/175
JP 2001-270133 10/2001

* cited by examiner

*Primary Examiner*—Ahn T. N. Vo
(74) *Attorney, Agent, or Firm*—Harness, Dickey & Pierce, P.L.C.

(57) ABSTRACT

In a liquid droplet ejection apparatus having a function liquid droplet ejection head which is mounted on a movable table and which ejects a function liquid droplet toward a workpiece in a manner synchronized with scanning by the movable table, and a function liquid supply apparatus, the function liquid supply apparatus is provided with a function liquid tank for supplying a function liquid, a connection tube of resin make for connecting the function liquid droplet ejection head and the function liquid tank together, a flexible rack member which moves the flexible rack member in a manner to follow the scanning of the function liquid droplet ejection head, and an earth connection which eliminates the static electricity accumulated in the connection tube as a result of contacting the connection tube. By thus earthing the connection tubes, the static electricity to be accumulated in the connection tube is removed.

22 Claims, 31 Drawing Sheets

LIQUID DROPLET EJECTION APPARATUS, METHOD OF MANUFACTURING ELECTRO-OPTIC DEVICE, ELECTRO-OPTIC DEVICE, AND ELECTRONIC APPARATUS

BACKGROUND OF THE INVENTION

1. Field of the Invention

This invention relates to a liquid droplet ejection apparatus in which a connection tube, or the like, made of a resin and connecting each of the relevant members together, e.g., a function liquid droplet ejection head and a function liquid tank together, is grounded. It also relates to: a method of manufacturing an electro-optic device; an electro-optic device; and an electronic apparatus.

2. Description of the Related Art

An ink jet printing apparatus which is conventionally known as a kind of liquid droplet ejection apparatus has mounted an ink jet head for ejecting ink on a carriage which is arranged to be movable back and forth (in a reciprocating manner). In the apparatus, the ink jet head and the ink cartridge (ink tank) for supplying the ink jet head with ink are connected together by an ink supply tube (connection tube) (see, e.g., Published Unexamined Japanese Patent Application No. 2001-270133).

The ink jet head (function liquid droplet ejection head) of this kind of ink jet printing apparatus is capable of ejecting minute ink droplets in the form of dots at a higher accuracy. Therefore, it is expected to be applied to the field of manufacturing various products. It is thus considered to introduce various kinds of liquid materials, as the function liquid, into the function liquid droplet ejection head of the liquid droplet ejection apparatus. As a result, since it is expected that various kinds of function liquids are introduced into the liquid droplet ejection apparatus, a corrosion resistant resin tube is used in a function liquid flow passage which leads from the function liquid tank for storing therein the function liquid to the function liquid ejection head.

In addition, the liquid droplet ejection apparatus is provided with a wiping unit for wiping away the function liquid that has adhered to the function liquid droplet ejection head. The wiping unit receives a supply of cleaning liquid from a cleaning liquid tank. In order to be prepared for the possibility that various kinds of cleaning liquids are used depending on the function liquids, a connection tube of resin make having corrosion resistance is used in the cleaning liquid flow passage from the function liquid tank to the wiping unit.

As described above, in the liquid droplet ejection apparatus, the function liquid flow passage and the cleaning liquid flow passage are constituted by connection tubes of resin make out of consideration of the corrosion resistance against the function liquid and the cleaning liquid. However, the connection tubes of resin make are liable to generate static electricity. In case a function liquid or a cleaning liquid using a solvent of low flash point is introduced, the static electricity may give rise to an adverse effect on the apparatus. In case an arrangement is made such that the connection tube moves to follow the scanning of the function liquid droplet ejection head, the static electricity is likely to occur particularly in the moving portions of the connection tube. As a result, there is a high possibility of giving an adverse effect on the apparatus.

SUMMARY OF THE INVENTION

This invention has an advantage of providing a liquid droplet ejection apparatus which is capable of removing static electricity generated in a connection tube, by grounding (or earthing) the connection tube, as well as a method of manufacturing an electro-optic device, an electro-optic device, and an electronic apparatus.

According to this invention, there is provided liquid droplet ejection apparatus having: a function liquid droplet ejection head which is mounted on a movable table and which ejects a function liquid droplet toward a workpiece in a manner synchronized with scanning by the movable table; and function liquid supply means for supplying the function liquid droplet ejection head with a function liquid. The function liquid supply means comprises: a function liquid tank for supplying a function liquid; a connection tube of resin make for connecting the function liquid droplet ejection head and the function liquid tank together; a flexible rack member fixed at one end thereof to the movable table and at an opposite end thereof to an apparatus frame so as to support thereon the connection tube in a manner movable to follow the scanning of the function liquid droplet ejection head; and grounding means disposed on the flexible rack member, for static elimination of the connection tube through the apparatus frame by keeping contact with the connection tube.

According to another aspect of this invention, there is provided a liquid droplet ejection apparatus having: a function liquid droplet ejection head; a wiping unit for wiping away a nozzle surface of the function liquid droplet ejection head by moving relative to the function liquid droplet ejection head; a movable table for mounting thereon the wiping unit so as to move the wiping unit relative to the function liquid droplet ejection head; and cleaning liquid supply means for supplying the wiping unit with a cleaning liquid for wiping. The cleaning liquid supply means comprises: a cleaning liquid tank for feeding a cleaning liquid; a connection tube of resin make for connecting the cleaning liquid tank and the wiping unit together; a flexible rack member fixed at one end thereof to the movable table and at an opposite end thereof to an apparatus frame so as to support thereon the connection tube in a manner movable to follow the movement of the wiping unit; and grounding means disposed on the flexible rack member, for static elimination of the connection tube through the apparatus frame by keeping contact with the connection tube.

According to the above arrangements, the flexible rack member to support thereon the connection tube in a manner movable to follow the scanning of the function liquid droplet ejection head or to follow the movement of the wiping unit is provided with grounding means for static elimination. Therefore, the generated static electricity can be quickly removed. In other words, that part of the connection tube which is supported by the flexible rack member is most likely to generate the static electricity as a result of the follow-up movement. By disposing the grounding means that comes into contact with the connection tube in that part in question, the generated static electricity can be efficiently removed. The meaning of "disposing the grounding means on the flexible rack member" includes not only the case in which the flexible rack member is provided with a separate member in the form of the electrically conductive member, but also a case in which the flexible rack member itself is constituted by an electrically conductive member (inclusive of a resin containing therein an electrically conductive material such as carbon, or the like).

Preferably, the grounding means is constituted by a static elimination sheet disposed on that supporting surface of the flexible rack member which supports the connection tube.

According to this arrangement, since the grounding means is constituted by the static elimination sheet, the grounding means will not be a hindrance even if it is disposed in the flexible rack member. In addition, by disposing the static elimination sheet on that supporting surface of the flexible rack member which supports the connection tube, the static elimination sheet can be brought into contact with the connection tube. As a result, the static electricity in the connection tube can be easily removed or eliminated. Still furthermore, even in case the connection tube is constituted in plural numbers, the static elimination sheet can be easily brought into contact with all the connection tubes simply by adjusting the width of the static elimination sheet. In this manner, all the connection tubes can be statically eliminated.

Preferably, the static elimination sheet is disposed over an entire length of the supporting surface of the flexible rack member.

According to this arrangement, since the static elimination sheet is disposed over the entire surface of the flexible rack member, the static elimination sheet is brought into contact with the entire length of the connection tube which is moved to follow by the flexible rack member. It follows that the static elimination sheet contacts that entire portion of the connection tube which is most likely to generate the static electricity, whereby the connection tube can be prevented from allowing the static electricity to partly remain therein.

Preferably, the static elimination sheet comprises a nap for static elimination provided on that surface of the static elimination sheet which comes into contact with the connection tube.

According to this arrangement, since there is provided the nap for static elimination which is provided on that surface of the static elimination sheet which comes into contact with the connection tube, the surface of contact between the static elimination sheet and the connection tube increases. As a result, the static electricity in the connection tube can be efficiently removed.

Preferably, the liquid droplet ejection apparatus further comprises an electrically conductive coupling for grounding the connection tube through the apparatus frame. The coupling is interposed in a non-moving portion except for that part of the connection tube which is supported by the flexible rack member.

According to this arrangement, grounding of the non-moving portion of the connecting tube, i.e., that part of the connection tube which does not move to follow the scanning of the function liquid droplet ejection head, is made through the apparatus frame by means of the coupling. Therefore, the static electricity generated in the non-moving part of the connection tube can be eliminated. The electrically conductive coupling includes not only a metallic coupling made of stainless steel, copper, brass, or the like, but also a coupling made of an electrically conductive resin having mixed therein an electrically conductive material such as carbon, or the like.

Preferably, the coupling is disposed in the non-moving portion of the connecting tube at a predetermined interval.

According to this arrangement, since the coupling is disposed in the non-moving portion of the connecting tube at a predetermined interval, the static electricity generated at the non-moving portion of the connection tube can be eliminated at each of the predetermined interval. The effect of the generated static electricity can thus be minimized to the smallest extent possible.

Preferably, grounding of the coupling is made through the apparatus frame by means of an electrically conductive coupling supporting fixture.

According to this arrangement, since the grounding of the non-moving portion of the connecting tube is made through the apparatus frame by means of the coupling supporting fixture which supports the coupling, there is no need of separately providing a coupling of special shape or a member to ground by means of the coupling. The space to dispose the member can thus be omitted to thereby simplify the construction of the apparatus.

The method of manufacturing an electro-optic device according to this invention comprises forming a film forming part with a function liquid droplet ejected from the above-described function liquid droplet ejection head toward the workpiece by using the above-described liquid droplet ejection apparatus.

The electro-optic device according to this invention comprises a film forming part formed by a function liquid droplet ejected from the above-described function liquid droplet ejection head toward the workpiece by using the above-described liquid droplet ejection apparatus.

According to the above arrangement, since the device is formed by using the liquid droplet ejection apparatus which enables the ejection of variety of function liquids, the electro-optic device can be manufactured at a high efficiency. As the electro-optic device, there can be listed a liquid crystal device, an organic electro-luminescence device, an electron emission device, a plasma display panel (PPD) device, an electrophoretic display device, or the like. The electron emission device is a concept inclusive of a so-called field emission display (FED) device, and a surface-conduction electron-emitter display (SED) device. Furthermore, as the electro-optic device, there may be included an apparatus for forming metallic wiring, for forming a lens, for forming a resist, for forming a light diffusion body, or the like.

The electronic apparatus according to this invention is characterized in that the above-described electro-optic device is mounted thereon.

In this case, the electronic apparatus corresponds to a mobile telephone, a personal computer, other various electric devices having mounted thereon a so-called flat panel display.

BRIEF DESCRIPTION OF THE DRAWINGS

The above and other objects and the attendant features of this invention will become readily apparent by reference to the following detailed description when considered in conjunction with the accompanying drawings wherein.

DETAILED DESCRIPTION OF THE PREFERRED EMBODIMENTS

A description will now be made about the preferred embodiment of this invention with reference to the accompanying drawings.

Figure 1:
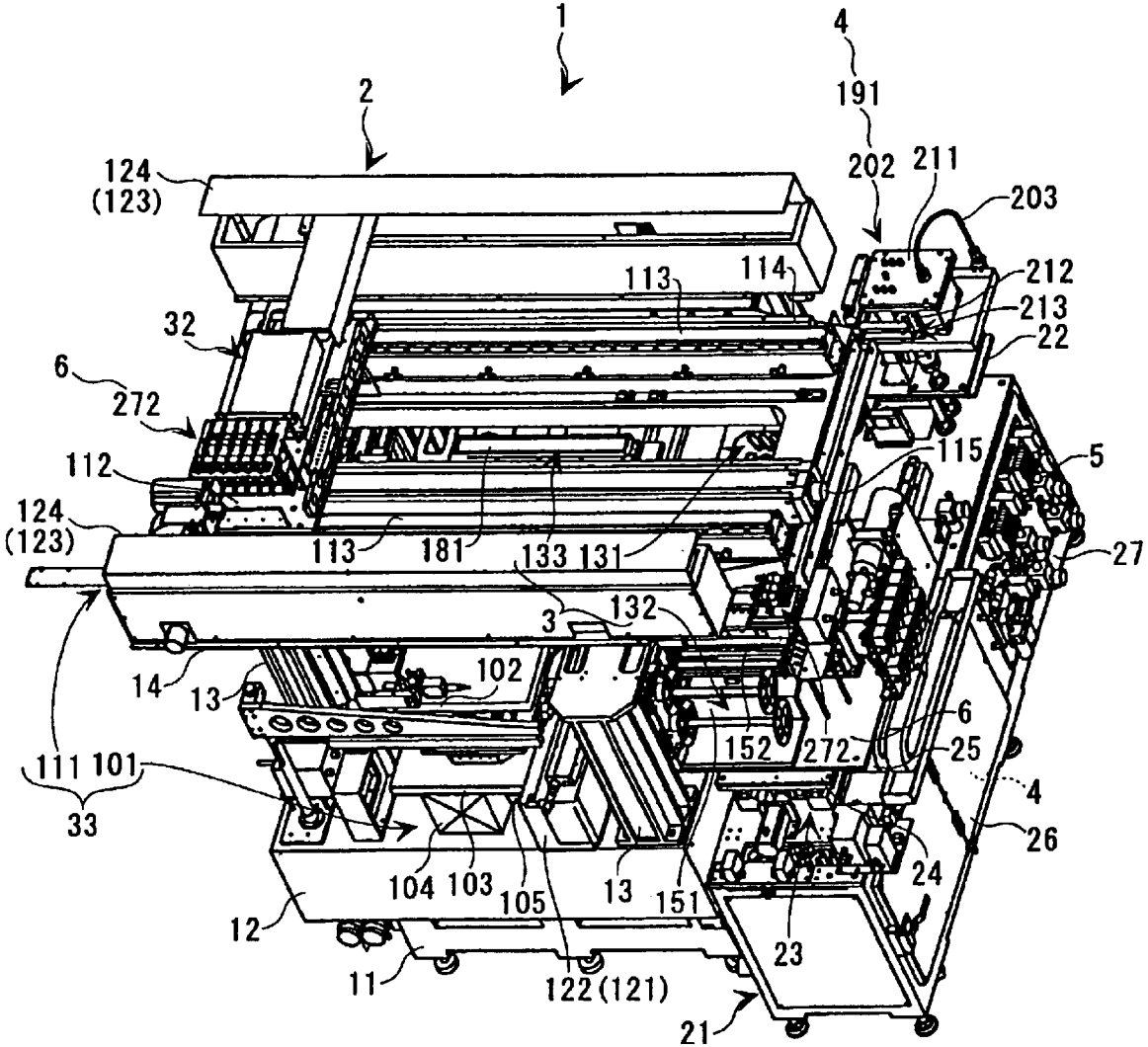
FIG. 1 is an external perspective view of a function liquid droplet ejection apparatus according to an embodiment of this invention.
Figure 2:
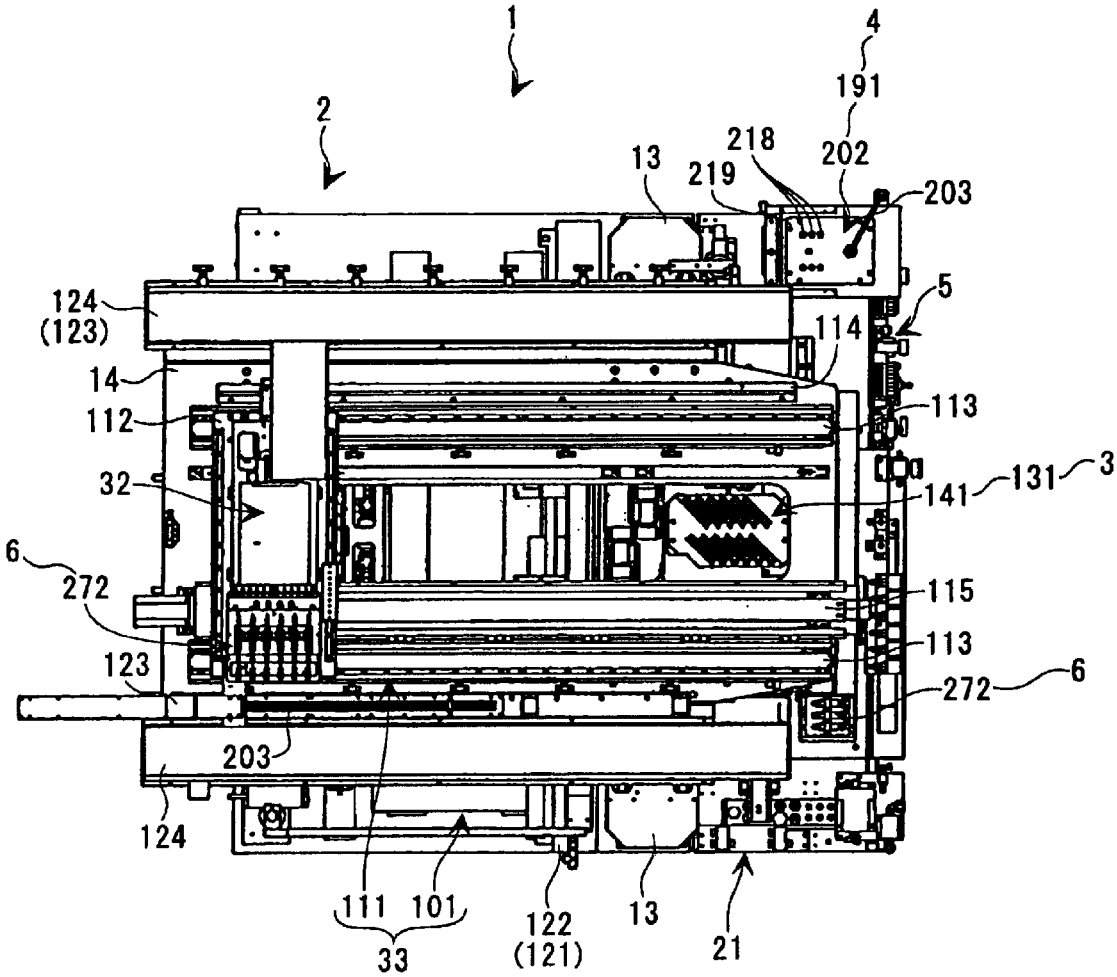
FIG. 2 is an external plan view thereof.
Figure 3:
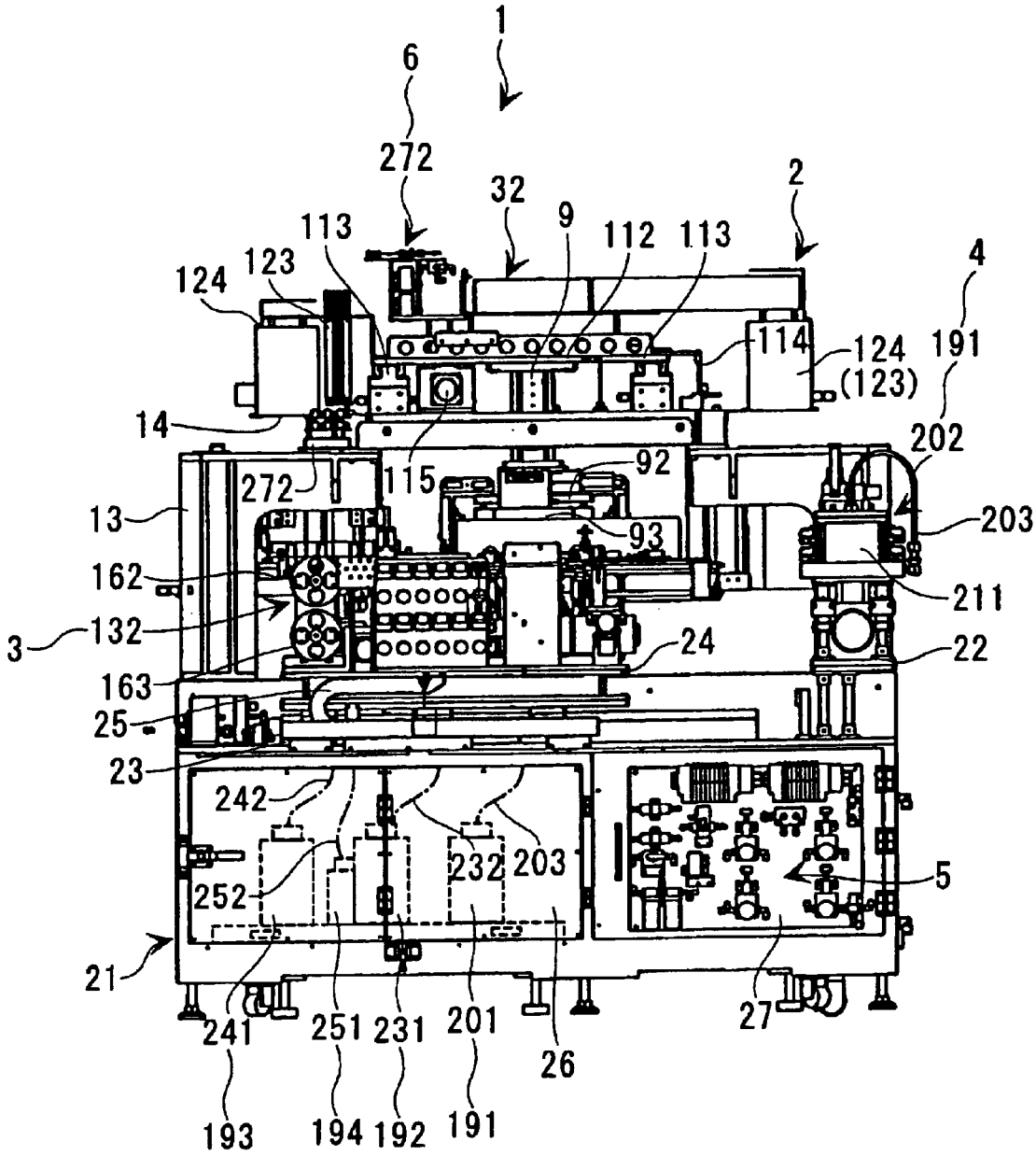
FIG. 3 is an external right-side view thereof.

FIG. 1 is an external perspective view of a liquid droplet ejection apparatus to which this invention is applied. FIG. 2 is an external plan view thereof and FIG. 3 is an external side view thereof. Although details are given hereinafter, a liquid droplet ejection apparatus 1 introduces function liquids such as special inks, light-emitting resin liquids, or the like, into function liquid droplet ejection heads 41 so as to form a film-forming portion by means of function liquid droplets on a workpiece W such as a substrate, or the like.

In the description of this invention, constituting elements, parts, or the like, will sometimes be referred to in a singular form (e.g., an element, a part, or the like) where there are actually a plurality of such elements, parts, or the like. In such a case, it is to be understood that such a reference is being made to a typical or representative one out of a plurality of elements, parts, or the like, partly to simplify the description.

As shown in FIGS. 1 through 3, a liquid droplet ejection apparatus 1 is made up of: ejection means 2 for ejecting function liquid droplets; maintenance means 3 for performing maintenance on the ejection means 2 (i.e., for keeping the ejection means 2 in good or well-maintained operating conditions); liquid supply/recovery means 4 for supplying the ejection means 2 with function liquids and also for recovering the function liquids not required any longer; and air supply means 5 for supplying each of the means with compressed air to be used for controlling each of the means. Each of these means is controlled by control means 7 in co-relation with each other. The liquid droplet ejection apparatus 1 is provided with grounding means 6 for removing static electricity that has been generated inside the apparatus (this work is also referred to as static elimination, and is made by connection to an apparatus frame, to be described later, which is connected to the ground in a suitable manner). Although not illustrated, the liquid droplet ejection apparatus 1 is further provided with auxiliary devices such as workpiece recognition cameras for recognizing the position of the workpiece W, head recognition cameras for recognizing the position of a head unit 31 (to be described hereinafter) of the ejection means 2, various indicators, or the like. They are also controlled by the control means 7.

As shown in FIG. 1, a flushing unit 133 (to be described hereinafter) for the ejection means 2 and the maintenance means 3 is disposed on a surface table or surface board 12 which is fixed to an upper portion of a supporting frame 11 which is constituted by assembling L-shaped structural materials (angles) into a rectangular shape. The liquid supply/recovery means 4 and the air supply means 5 are for the most part housed into a machine base 21 which is affixed to the supporting frame 11. The machine base 21 has formed therein two, one large and one small, housing chambers 26, 27. The large housing chamber 26 houses therein tanks, or the like, for the liquid supply/recovery means 4, and the small housing chamber 27 houses therein the main parts of the air supply means 5. The machine base 21 has disposed thereon: a tank base 22 for mounting thereon a liquid supply tank 202 (to be described hereinafter) for the liquid supply/recovery means 4; and a movable table 23 which is supported in a manner to be slidable in the longitudinal direction of the machine base 21. The movable table 23 has fixed to an upper portion thereof a common base 24 for mounting thereon a suction unit 131 (to be described hereinafter) for the maintenance means 3, and a wiping unit 132. The movable table 23 has disposed on one side thereof a flexible rack member 25 in parallel therewith and supports thereon or contains therein cables, or the like, to be connected to the suction unit 131 and the wiping unit 132 (This flexible rack member is arranged to lie in an articulated manner so as to be flexed and extended as illustrated. One product is commercially known by a trademark of "CABLEVEYOR"). The members for use in mounting/fixing each of the means, such as the supporting frame 11, the stone surface table 12, the machine base 21, the tank base 22, or the like, are generically referred to as an apparatus frame 10.

This liquid droplet ejection apparatus 1 is to supply the function liquid droplet ejection head 41 with the function liquid from the liquid supply tank 202 of the liquid supply/recovery means 4, while causing the function liquid droplet ejection head 41 of the ejection means 2 to be well maintained by the maintenance means 3, and also to eject the function liquid toward the workpiece W from the function liquid droplet ejection head 41. A description will now be made about each of the means.

The ejection means 2 is made up of: a head unit 31 having a plurality of function liquid droplet ejection heads 41 for ejecting the function liquids; a main carriage 32 for supporting the head unit 31; and an X/Y moving mechanism 33 which places thereon the workpiece W and which subjects the workpiece W to scanning relative to the function liquid droplet ejection heads 41.

Figure 4:
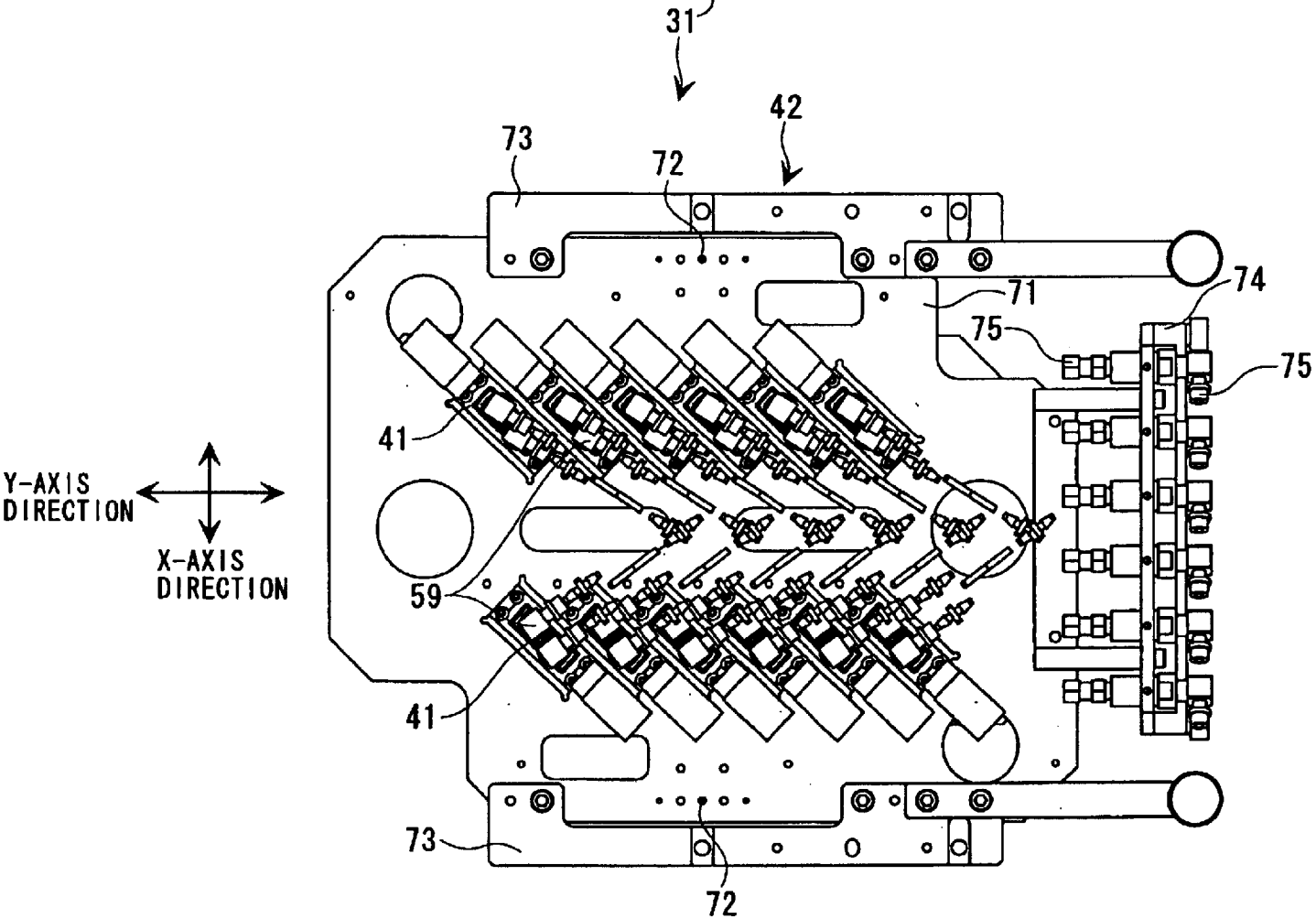
FIG. 4 is a plan view a head unit.
Figure 5A:
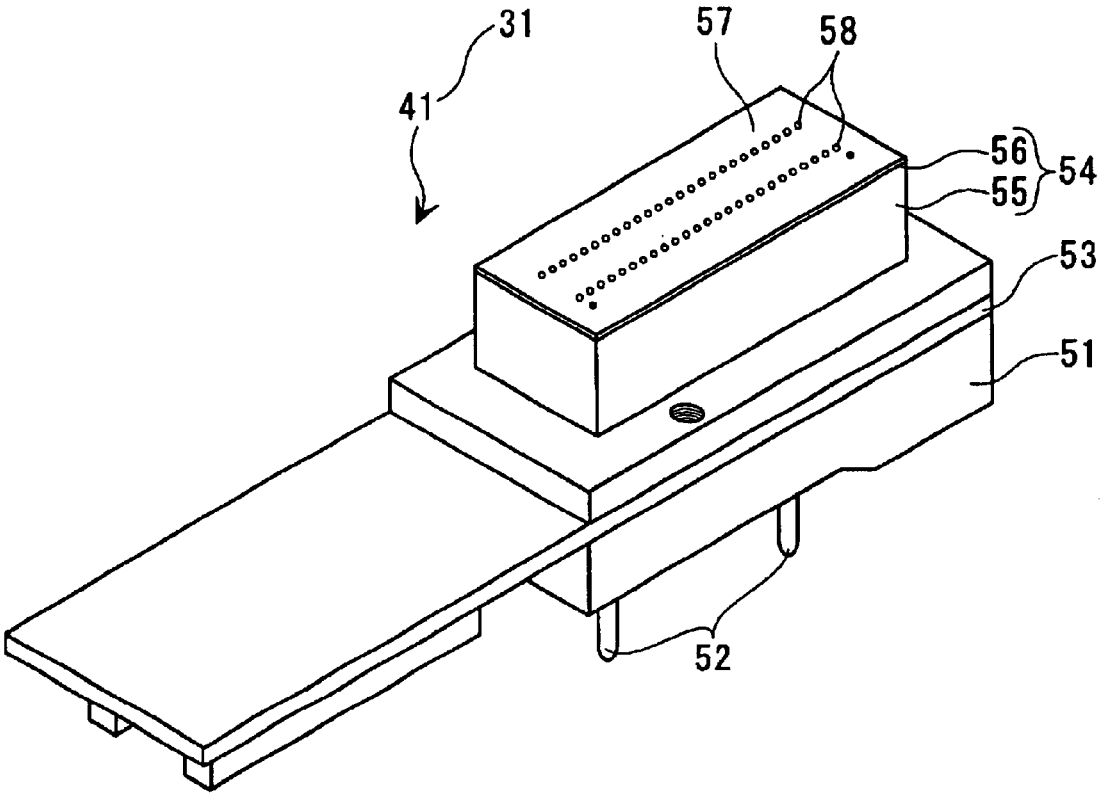
FIG. 5A is an external perspective view of a function liquid droplet ejection head and FIG. 5B is a sectional view in a state in which the function liquid droplet ejection head is mounted on a piping adapter.
Figure 5B:
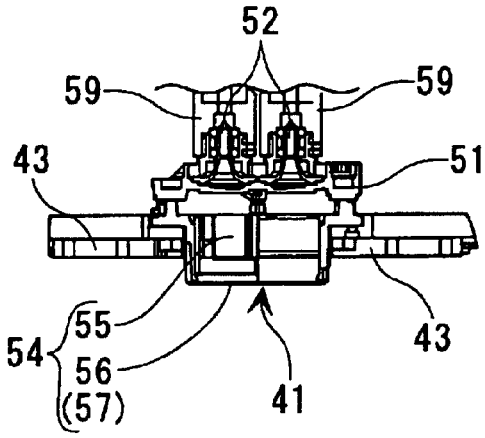

As shown in FIGS. 4 and 5, the head unit 31 is made up of: a plurality of (twelve) function liquid droplet ejection heads 41; a sub-carriage 42 for mounting thereon the plurality of the function liquid droplet ejection heads 41; and a head holding member 43 for mounting each of the function liquid droplet ejection heads 41 on the sub-carriage 42. The twelve function liquid droplet ejection heads 41 are divided into two, each containing six, and are disposed on the sub-carriage 42 at a predetermined angle to the workpiece W in order to secure a sufficient coating density of the function liquid. Each group of the divided six function liquid droplet ejection heads 41 is disposed with a deviation in a sub-scanning direction (Y-axis direction) relative to the other group of the divided six function liquid droplet ejection heads 41 so that ejection nozzles 58 of each of the function liquid droplet ejection heads 41 are continuous (partly overlapped). In case the function liquid droplet ejection heads 41 are made of exclusively used component parts, so that a sufficient coating density can be secured relative to the workpiece W, the function liquid droplet ejection heads 41 need not be set in position at an angle.

As shown in FIG. 5A, the function liquid droplet ejection head 41 is of a so-called twin type and is made up of: a function liquid introduction part 51 which has twin connection needles 52; a twin-type of head substrate 53 which is connected to the function liquid introduction part 51; and a head main body 54 which is in communication with a lower portion of the function liquid droplet introduction part 51. Each of the connection needles 52 is connected to the liquid supply tank 202 of the liquid supply/recovery means 4 through a piping adapter 59 so that the function liquid introduction part 51 can be supplied with the function liquid from each of the connection needles 52. The head main body 54 has a nozzle forming plate 56 having formed therein two rows of ejection nozzles 58 made up of a twin-pump part 55 and a multiplicity of ejection nozzles 58. Inside the head main body 54 are formed in-head flow passages filled with the function liquid. The function liquid droplet ejection heads 41 are arranged to eject the function liquid droplet out of the ejection nozzles 58 through the function of the pump part 55.

As shown in FIG. 4, the sub-carriage 42 is made up of: a main body plate 71 which is partly cut off; a pair of left and right reference pins 72 which are disposed at an intermediate position of a longer side of the main body plate 71; and a pair of left and right supporting members which are attached to the respective longitudinal sides of the main body plate 71. The pair of the reference pins 72 serve to be a reference (or standard) in positioning (position recognition of) the sub-carriage 42 (head unit 31) in the X-axis, Y-axis, and Θ-axis directions, based on image recognition. The supporting member 73 serves as a fixing member in positioning the head unit 31 to the main carriage 32. The sub-carriage 42 is provided with a piping joint 74 for connecting with pipes each of the function liquid droplet ejection heads 41 and the liquid supply tank 202. The piping joint 74 is provided with twelve sockets 75 having connected: to one end thereof a head-side piping member from a piping adapter 59 which is communicated with each of the function liquid droplet ejection heads 41 (connecting needle 52); and to the other end thereof an apparatus-side piping member from the liquid supply tank 202.

The main carriage 32 is made up of: a suspending member 91 which is I-shaped in external appearance and which is suspended from a lower side of a bridge plate 112; a Θ table which is attached to a lower side of the suspending member 91; and a carriage main body 93 which is attached in a suspended manner to a lower side of the Θ table (see FIG. 3). The carriage main body 93 has a rectangular opening into which the head unit 31 is loosely fit for fixing after alignment. The carriage main body 93 has disposed therein a workpiece recognition camera for taking in error correction data on a carriage moving axis.

The X/Y moving mechanism 33 is fixed to the stone surface table 12 and serves to perform the main scanning (in the X-axis direction) of the workpiece W and also to perform the sub-scanning (in the Y-axis direction) of the head unit 31 through the main carriage 32. As shown in FIG. 1, the X/Y moving mechanism 33 is made up of: an X-axis table 101 which is directly fixed to the stone surface table 12 by aligning its axial line with the center line along the long sides of the stone surface table 12; and a Y-axis table 111 which bridges the X-axis table 101 by means of four supporting columns 13 fixed to the stone surface table 12 so that the axial line thereof is aligned with the center line along the shorter sides of the stone surface table 12.

As shown in FIG. 1, the X-axis table 101 is made up of: a suction table 102 which sucks the workpiece W with air for setting it in position; a Θ table 103 for supporting the suction table 102; an X-axis air slider 104 which supports the Θ table 103 in a manner slidable in the X-axis direction; an X-axis linear motor (not illustrated) which moves the workpiece W on the suction table 102 in the X-axis direction through the Θ table 103; and an X-axis linear scale 105 which is disposed in parallel with the X-axis slider 104. The main scanning of the function liquid droplet ejection head 41 is performed by driving the X-axis linear motor, whereby the suction table 102 with the workpiece W sucked thereto and the Θ table 103 are moved back and forth in the X-axis direction with the X-axis slider 104 serving as the guides.

In parallel with the X-axis linear scale 105, the X-axis flexible rack member 121 is disposed. The X-axis flexible rack member 121 houses therein (or supports thereon) vacuum tubes which are connected to the air supply means 5 to thereby suck the workpiece W through the suction table 102, the vacuum tube, cables and tubes to be connected to the Θ table, or the like, and is covered by a box 122.

As shown in FIGS. 1 through 3, the Y-axis table 111 (movable table) is mounted on a mounting plate 14 disposed on four supporting columns 13, and is made up of: a bridge plate 112 which suspends the main carriage 32; a pair of Y-axis sliders 113 which support the bridge plate on both ends so as to be slidable in the Y-axis direction; a Y-axis linear scale 114 which is disposed in parallel with the Y-axis slider 113; a Y-axis ball screw which moves the bridge plate 112 guided by the pair of Y-axis ball screws 115; and a Y-axis motor (not illustrated) which rotates the Y-axis ball screw 115 in one direction and in the opposite direction. The Y-axis motor is made of a servo motor and, if the Y-axis motor is rotated in one direction and in the opposite direction, the bridge plate 112 which is engaged in a screwed manner with the Y-axis motor through the Y-axis ball screw 115 is moved in the Y-axis direction with the pair of Y-axis sliders 113 serving as the guides. In other words, as a result of the movement of the bridge plate 112, the main carriage 32 (head unit 31) is moved back and forth in the Y-axis direction, whereby the sub-scanning of the function liquid droplet ejection head 41 can be performed.

As shown in FIGS. 1 through 3, on both outer sides of the pair of the Y-axis sliders 113, there are provided a pair of flexible rack members 123 which are disposed in parallel with the Y-axis slider 113 and are housed in boxes 124. Each of the Y-axis flexible rack members 123 is fixed at one end thereof to the bridge plate of the Y-axis table 111 and is fixed at the other end thereof to the mounting plate 14. The Y-axis flexible rack members 123 protect the cables and tubes in a flexible manner, and cause the cables and tubes to follow the movement of the main carriage 32 (head unit 31). The Y-axis flexible rack member 123 on this side as seen in the figure (FIG. 1) houses therein (or supports thereon) the liquid supply tube 203 which connects the liquid supply tank 202 and the function liquid ejection head 41 together.

A description will now be made about a series of operations of the ejection means 2. First, in preparation for the ejection of the function liquid, the position recognition of the head unit 31 is made by the head recognition camera. Thereafter, the positional correction of the workpiece W set in position on the suction table 102 is performed by the workpiece recognition camera. Then, the workpiece W is moved back and forth in the main scanning direction by the X/Y moving mechanism 33 (X-axis table 101), and also the plurality of function liquid droplet ejection heads 41 are operated to thereby perform the selective ejection operation of the function liquids toward the workpiece W. After the workpiece W has been moved backward, the head unit 31 is moved in the sub-scanning direction by the X/Y moving mechanism 33 (Y-axis table 111) to thereby perform the back and forth movement of the workpiece W in the main scanning direction and the driving of the function liquid droplet ejection heads 41. In this embodiment, the arrangement has been made such that the workpiece W is moved in the main scanning direction relative to the workpiece W. However, an arrangement may also be made such that the workpiece W is moved in the main scanning direction. Further, it may also be so arranged that the head unit 31 is fixed and that the workpiece W is moved in the main scanning direction and in the sub-scanning direction.

A description will now be made about the maintenance means 3. The maintenance means 3 is to maintain (i.e., keep in good operation conditions) the function liquid droplet ejection heads 41 so that the function liquid droplet ejection heads 41 can adequately eject the function liquids, and is provided with the suction unit 131, the wiping unit 132, and the flushing unit 133 (see FIG. 1).

The suction unit 131 is mounted on a common machine base 24 of the above-described machine base 21 and is arranged to be slidable in the longitudinal direction of the machine base 21, i.e., in the X-axis direction, through the movable table 23. The suction unit 131 is to keep the function liquid droplet ejection heads 41 in a well-maintained state by sucking the function liquid droplet ejection heads 41, and is used at the time when the function liquid droplet ejection heads 41 of the head unit 31 are filled with the function liquids, or at the time when suction (or cleaning) is performed to remove the function liquids whose viscosity has increased inside the function liquid droplet ejection heads 41.

Figure 6:
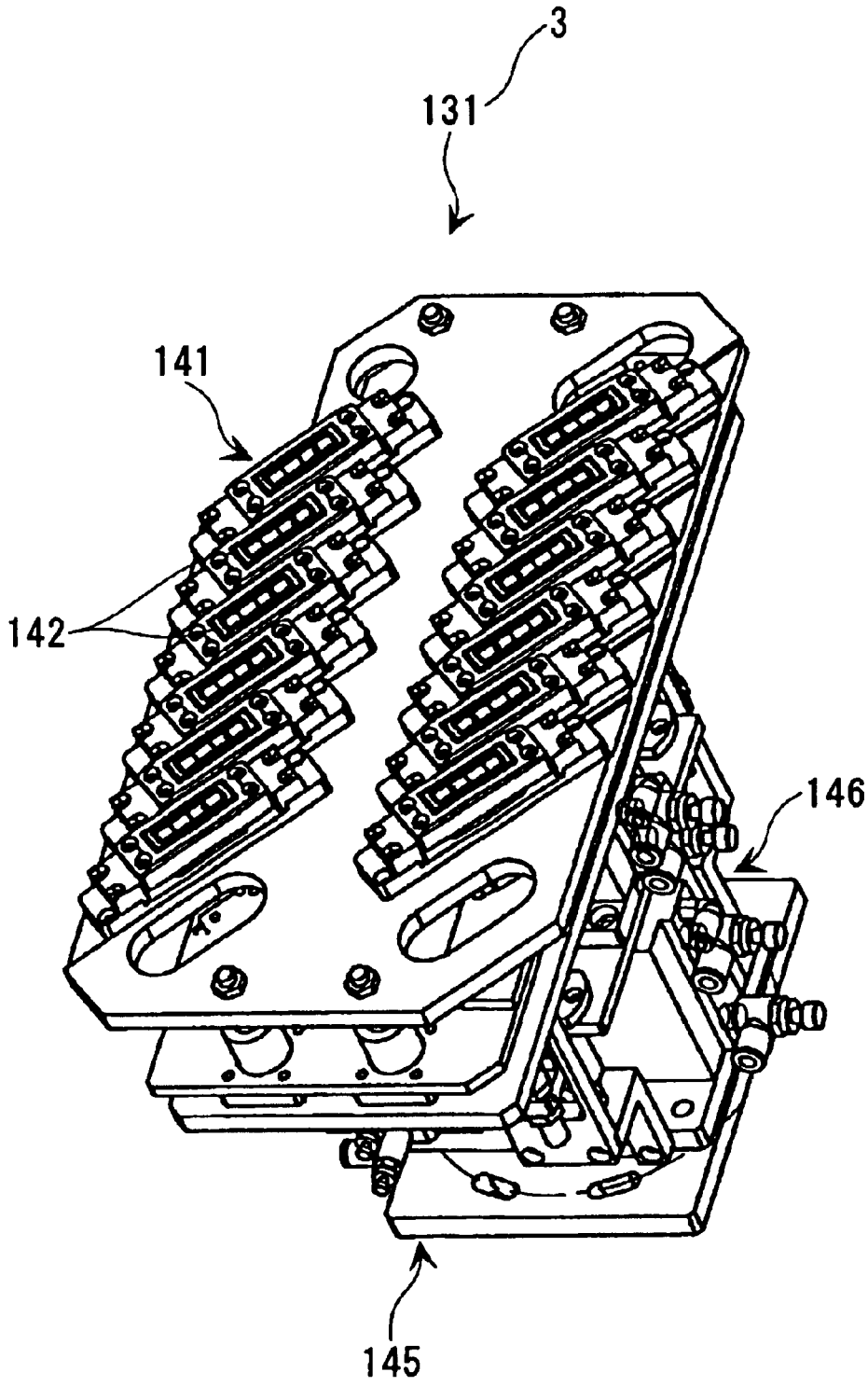
FIG. 6 is an external perspective view of a suction unit.

As shown in FIG. 6, the suction unit 131 is made up of: a cap unit 141 which has twelve caps 142 for coming into close contact (or adhesion) with each of the function liquid droplet ejection heads 41; a function liquid suction pump 143 which performs suction of the function liquids through the caps 142 that have been closely adhered; a suction tube 144 which is connected between each of the caps 142 and the function liquid suction pump 143; a supporting member 145 which supports the cap unit 141; and a lifting mechanism 146 which moves up and down the cap unit 141 through the supporting member 145, thereby causing the caps 142 to move toward and away from the function liquid droplet ejection heads 41.

The wiping unit 132 receives the supply of the cleaning liquid from a cleaning tank 241 of the liquid supply/recovery means 4 (to be described hereinafter) to thereby wipe away the nozzle forming surface 57 (nozzle surface) of each of the function liquid droplet ejection heads 41, and is disposed on the common base 24 together with the suction unit 131. In other words, by the driving of the movable table 23, the suction unit 131 and the wiping unit 132 move in the X-axis direction through the common base 24. After the suction unit 131 has sucked the function droplet ejection heads 41 of the head unit 31, the movable table is driven to thereby cause the head unit 31 to face the wiping unit 132. The nozzle surfaces of the function liquid droplet ejection heads 41 that have been stained as a result of the suction operation can thus be wiped away by the wiping unit 132.

Figure 7:
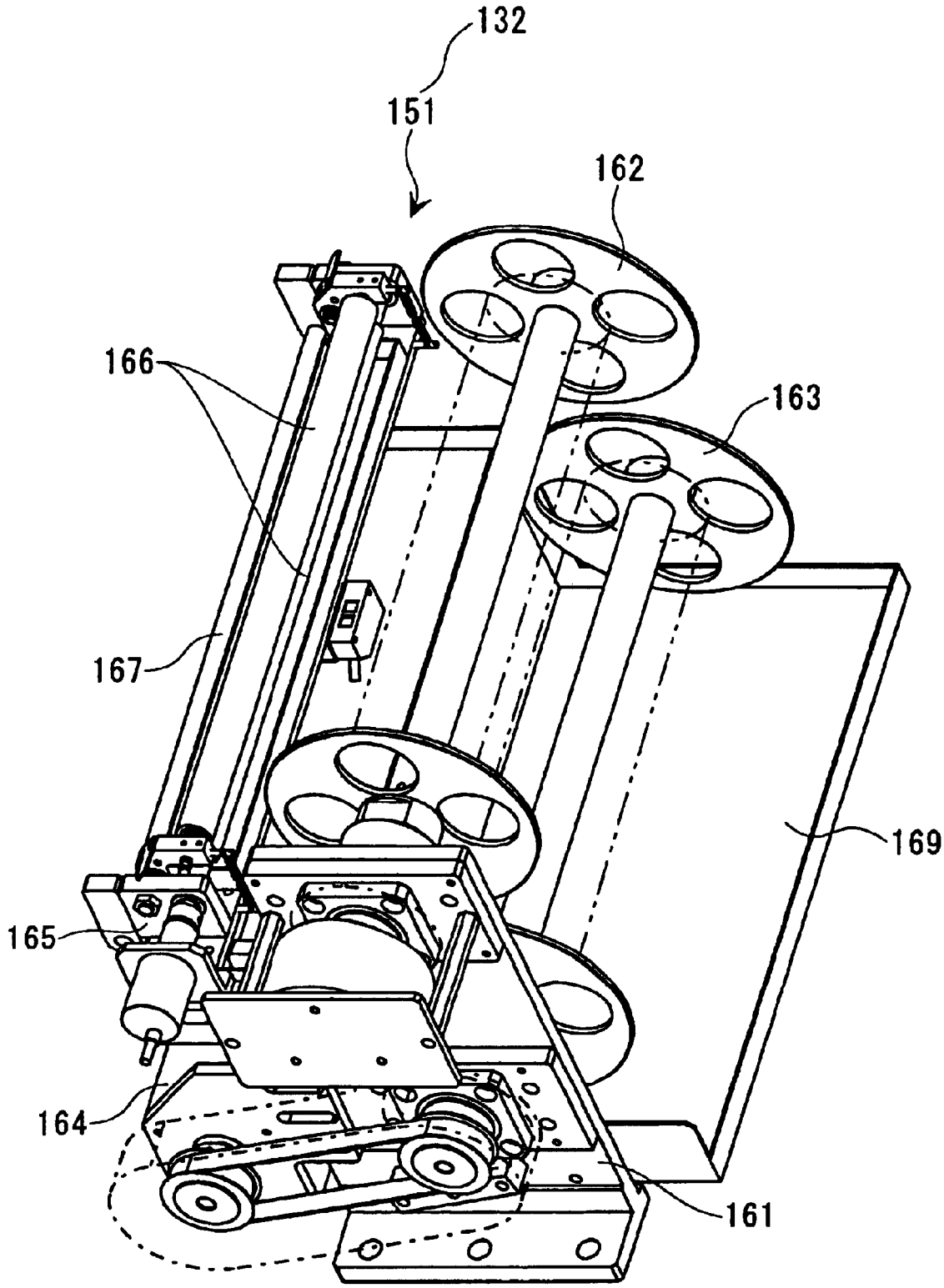
FIG. 7 is an external perspective view of a take-up unit of a wiping unit.

As shown in FIG. 1, the wiping unit 132 is made up of: a take-up unit 151 and a wipe-away unit 152 which are disposed on the common base 24 in abutment with each other. As shown in FIG. 7, the take-up unit 151 is made up of: a cantilever type of frame 161; an upper delivery reel 162 and a lower take-up reel 163 which are rotatably supported on the frame 161; and a take-up motor 164 which rotates the lower take-up reel 163. On an upper portion of the frame 161, there is fixed a sub-frame 165. On this sub-frame 165, there are supported a speed detecting roller 166 and an intermediate roller 167 in a manner to be respectively supported on both ends thereof. A cleaning liquid pan 169 for receiving the cleaning liquid (to be described hereinafter) is disposed on the lower side of these rollers.

Figure 12:
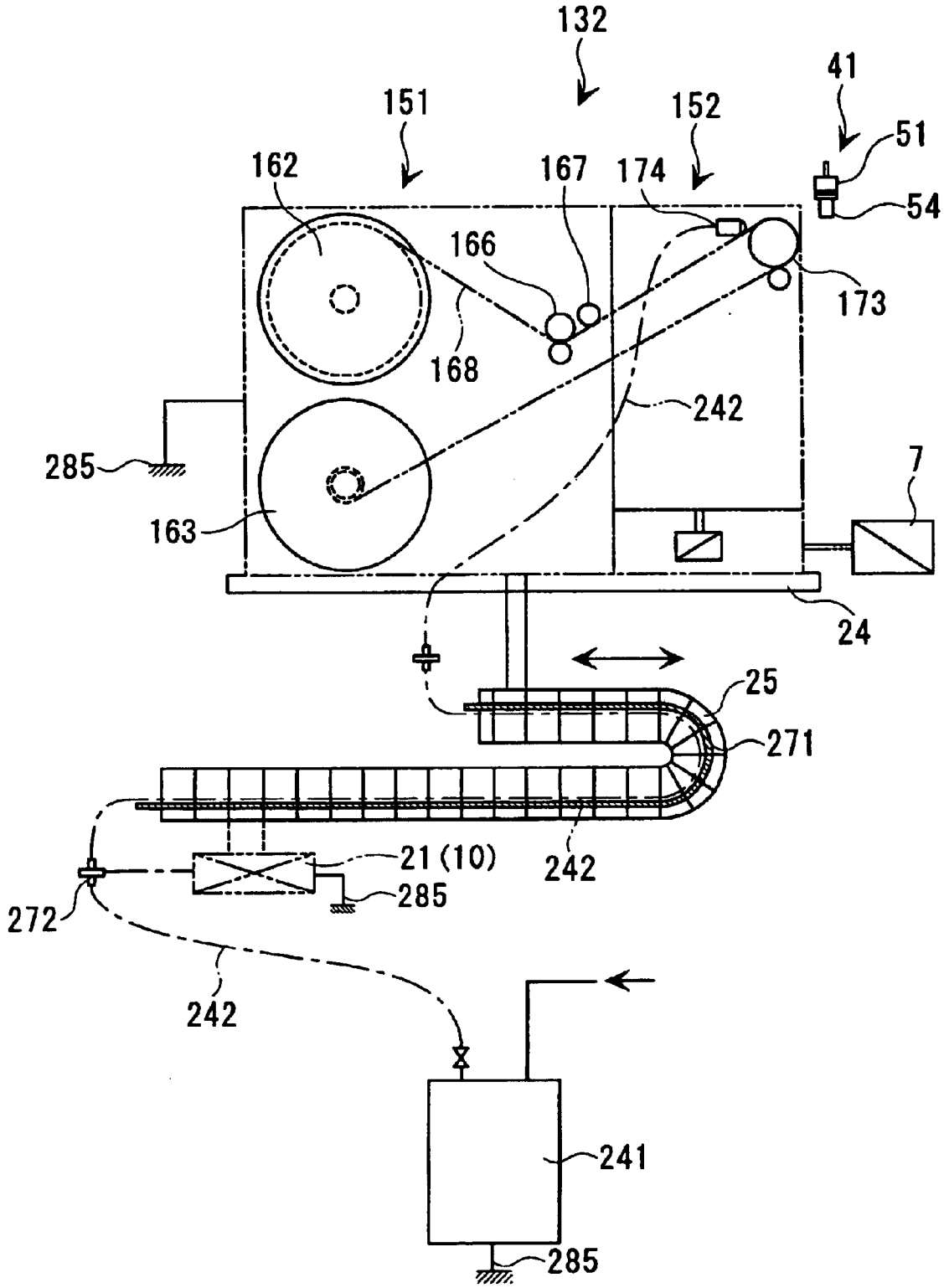
FIG. 12 is a schematic diagram of grounding means around a recovery tube.

As shown in FIG. 12, the delivery reel 162 has filled therein a wiping sheet 168 of rolled shape. The wiping sheet 168 delivered out of the delivery reel 162 is sent to the wipe-away unit 152 through the speed detecting roller 166 and the intermediate roller 167, and is further taken up by the take-up reel 163 through a wiping roller 173 (to be described hereinafter).

Figure 8:
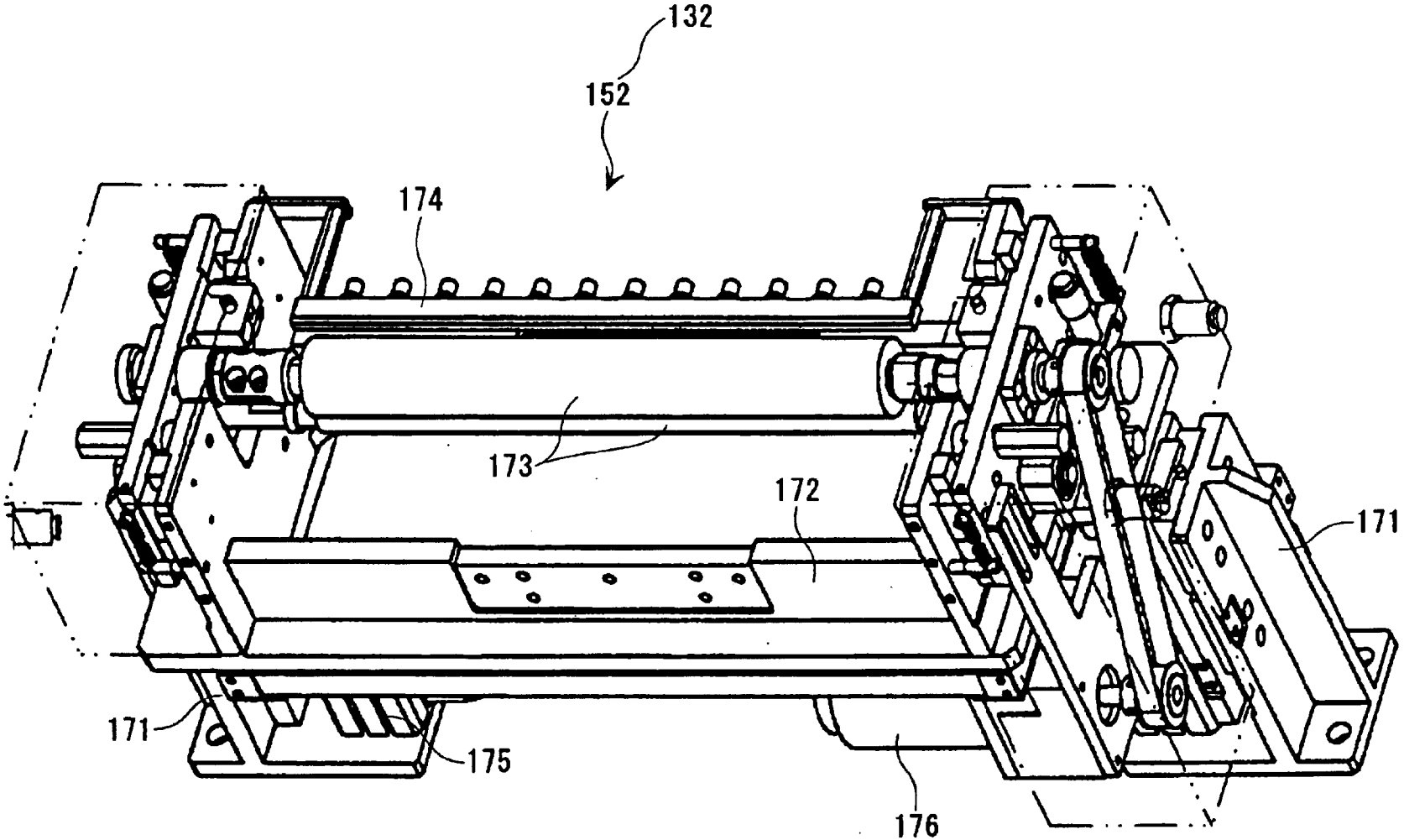
FIG. 8 is an external perspective view of a wiping unit of the wiping unit.

As shown in FIG. 8, the wipe-away unit 152 is made up of: a pair of left and right stands 171; a base frame 172 which is U-shaped in cross section and is supported by the pair of the left and right stands 171; the wiping roller 173 which is made of a grip roller and is rotatably supported by the base frame 172 at both ends of the wiping roller 173; a cleaning liquid spray head 174 which lies in parallel with the wiping roller 173; and a pair of air cylinders 175 which move up and down the base frame 172.

The cleaning liquid spray head 174 is disposed near the wiping roller 173 and sprays the wiping sheet 169 to be sent from the intermediate roller 167 with the cleaning liquid. For this purpose, at the front surface of the cleaning liquid spray head 174, i.e., on the side of the wiping roller 173, there are laterally disposed a plurality of cleaning liquid spray heads 174 to suit the length of the wiping sheet 168. On the rear surface of the cleaning liquid spray head 174, there are disposed a plurality of connectors for coupling the tubes 241 to be communicated with the cleaning liquid tank 241. Although not illustrated, the wiping unit 151 is also provided with a cleaning liquid pan for receiving the cleaning liquid to be dripped from the wiping sheet 168.

With reference to FIG. 12, a description will now be made about a series of wiping operations of the wiping unit 132. When the suction by the head unit 31 (function liquid droplet ejection head 41) has been finished, the movable table 23 is driven to thereby move forward the wiping unit 132 so as to come close enough to the head unit 31. When the wiping roller 173 has moved to the neighborhood of the function liquid droplet ejection heads 41, the driving of the movable table 23 is stopped, and both the air cylinders 175 are driven to move upward the wiping roller 173. As a result, the wiping roller 173 is brought into contact with (urged against) the function liquid droplet ejection heads 41.

Then, by driving the take-up motor 164, the wiping sheet 168 is delivered and, also, the spraying of the cleaning liquid is started to thereby impregnate the wiping sheet 168 with the cleaning liquid. At the same time, the movable table is driven to deliver the wiping sheet 168 and, also, the wiping roller 173 is moved forward to bring the lower surface (nozzle forming surface 57) of the plurality of function liquid droplet ejection heads 41 into sliding contact with the wiping sheet 168 for wiping purpose. Then, once the wiping operation has been finished, i.e., when the wiping roller 173 has passed through the lower surface of the function liquid droplet ejection heads 41, the delivering of the wiping sheet 168 is stopped and the wiping roller 173 I lowered. By driving the movable table 23, the wiping unit 132 is moved backward to the original position.

The flushing unit 133 is to receive the function liquid to be sequentially ejected in the flushing operation (preliminary ejection) of the plurality of (twelve) function liquid droplet ejection heads 41 at the time of liquid droplet ejection. The flushing unit 133 is fixed to the Θ table 103 with the suction table 102 of the X-axis table 101 in between, and is provided with a pair of flushing boxes 181 to receive the ejected function liquid. Since the flushing boxes 181 are moved as a consequence of the main scanning, the head unit 31, or the like, need not be moved for the flushing operation. In other words, since the flushing boxes 181 are moved toward the head unit 31 together with the workpiece W, the flushing operation can be performed sequentially from that ejection nozzle 58 of the function liquid droplet ejection heads 41 which faces the flushing boxes 181. The function liquid received by the flushing boxes 181 is stored in a waste liquid tank 251 to be described hereinafter.

The flushing operation is to eject the function liquid from all the ejection nozzles 58 of the function liquid droplet ejection heads 41. With the lapse of time, the function liquid introduced into the function liquid droplet ejection heads 41 increases in viscosity as a result of drying. As a result, the ejection nozzles 58 of the function liquid droplet ejection heads 41 are likely to be clogged. The flushing is regularly performed to prevent such clogging. The flushing operation must be performed not only at the time of flushing of the function liquid, but also at the time when the flushing of the function liquid is temporarily stopped such as at the time of replacing the workpiece W, or the like. In such a case, the head unit 31 is moved to the suction position, i.e., to the position right above the cap unit 141 of the suction unit 131. Then, each of the function liquid droplet ejection heads 41 performs flushing toward each of the corresponding caps 142.

When flushing is performed toward the cap 142, the cap unit 141 has already been moved upward to a second position at which a slight clearance is generated between the function liquid droplet ejection heads 41 and the cap 142. Most part of the function liquid ejected by flushing is capable of being received by each of the caps 142. However, since the ejected function liquid is partly suspended and/or scattered in the form of mist, the following arrangement is employed in this embodiment. Namely, at the time of performing flushing toward the caps 142, air in the function liquid droplet ejection space is sucked through each of the caps 142. In other words, as a result of air suction, the mist is received by each of the caps 142 to thereby prevent the nozzle forming surface 57 of the function liquid droplet ejection heads 41 and the inside of the apparatus from getting stained with the mist. The air suction is performed by driving an air blower 147 which is connected to the caps (see FIG. 13).

A description will now be made about the liquid supply/recovery means 4. The liquid supply/recovery means 4 is made up of: a function liquid supply system 191 (function liquid supply apparatus) for supplying each of the function liquid droplet ejection heads 41 of the head unit 31 with the function liquid; a function liquid recovery system 192 which recovers the function liquid that has been sucked by the suction unit 131 of the maintenance means 3; a cleaning liquid supply system 193 which supplies the wiping unit 132 with a solvent for the function liquid for the purpose of cleaning; and a waste liquid recovery system 194 which recovers the function liquid received by the flushing unit 133. As shown in FIG. 3, the larger housing chamber 26 in the machine base 21 contains therein, a pressurized tank 201 of the function liquid supply system 191, a reuse tank 231 of the function liquid recovery system 192, and a cleaning liquid tank 241 of the cleaning liquid supply system 193, which are laterally disposed in the order described from the right side in the figure. In the neighborhood of the reuse tank 231 and the cleaning liquid tank 241, there are disposed that waste liquid tank 251 for the waste liquid recovery system 194 which is formed small in size.

Figure 13:
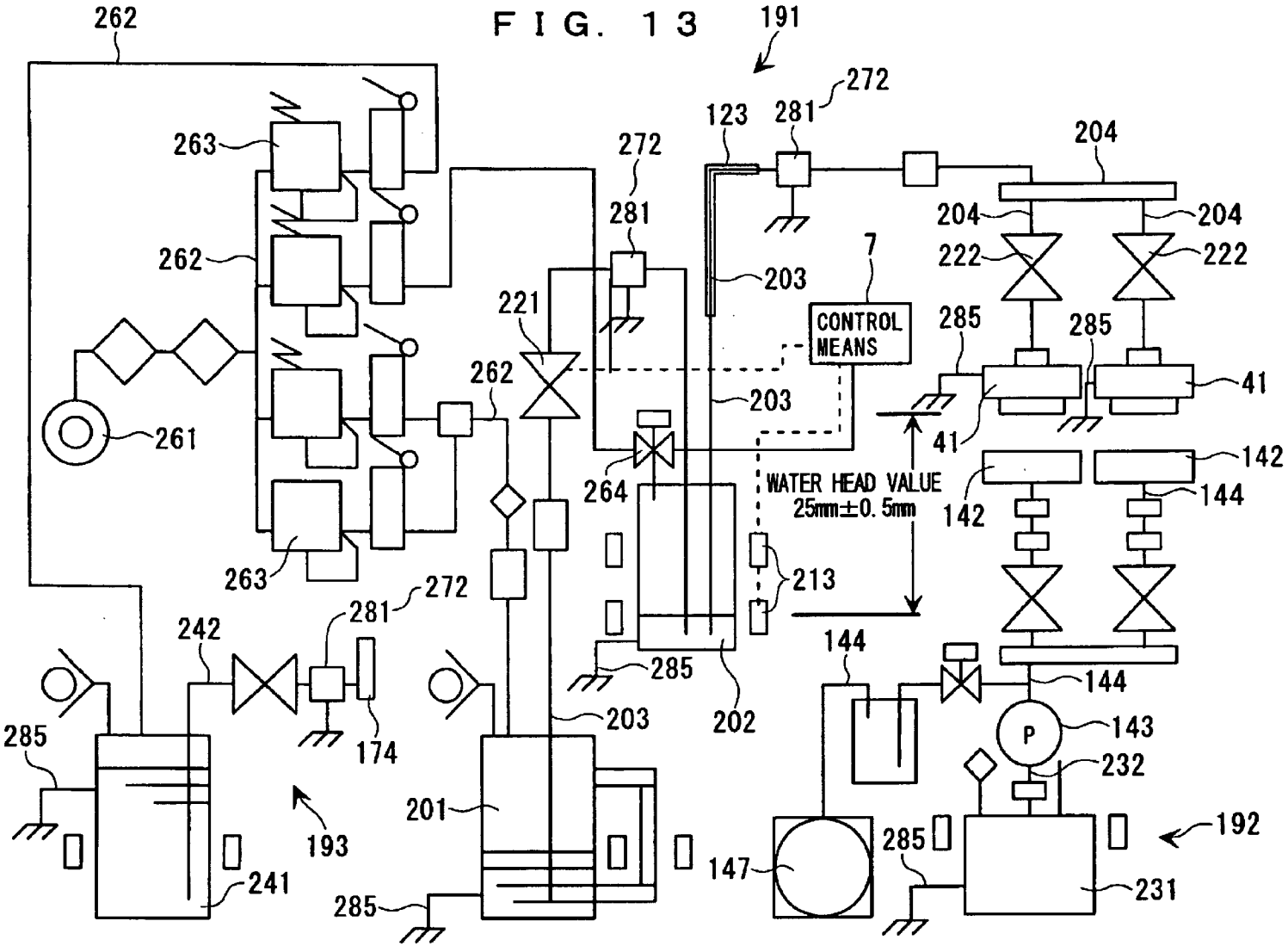
FIG. 13 is a schematic diagram showing around liquid supply and recovery means.

As shown in FIG. 13, the function liquid supply system 191 is made up of: the pressurized tank 201 for containing therein a large amount (3 liters) of function liquid; a liquid supply tank 202 which stores therein the function liquid that has been delivered from the pressurizing 202; and a liquid supply tube 203 (connection tube) which forms a liquid supply passage for connecting them. The pressurized tank 201 delivers (or sends) under pressure the function liquid to the liquid supply tank 202 for storing therein through the liquid supply tube 203, this delivering under pressure being performed by means of pressurized gas (inert gas) to be introduced from the air supply means 5.

The liquid supply tank 202 is fixed to the above-described tank base 22 as shown in FIGS. 1 through 3. It is provided with: liquid level peep holes 212 on both sides; a tank main body 211 which stores therein the function liquid from the pressurized tank 201; and liquid level detectors 213 which face both the liquid level peep holes 212 to thereby detect the liquid level of the function liquid.

As shown in FIG. 2, the liquid supply tube 203 which is in communication with the pressurized tank 201 is connected to an upper surface of (the cover of) the tank main body 211. There are further disposed: six liquid supply connectors 218 for the liquid supply tube 203 which extends to the head unit 31; and a pressurizing connector 219 for an air supply tube 262 to be connected to the air supply means 5. The liquid supply tube 203 connected to the pressurized tank 201 has interposed therein a liquid level adjusting valve 221. By controlling through opening and closing the liquid level adjusting valve 221 based on the result of detection by the liquid level detectors 213, the liquid level of the function liquid to be stored in the tank main body 211 is adjusted so as to always lie within a range capable of detection by the liquid level detectors 213 (see FIG. 13).

The air supply tube 262 to be connected to the pressurizing connector 219 has interposed therein a three-way valve 264 which has a vent port to atmosphere. The pressure from the pressurized tank 201 is relieved by opening (or releasing) to atmosphere. According to this operation, the head pressure in the liquid supply tube 203 which extends to the head unit 31 is held to a slightly negative water pressure (e.g., 25 mm±0.5 mm) by the above-described adjustment in the liquid level to thereby prevent the liquid from dripping out of the ejection nozzles 58 of the function liquid droplet ejection head 41. At the same time, it is so arranged that the liquid droplet can be ejected at a higher accuracy by the pumping operation of the function liquid droplet ejection head 41, i.e., the pumping drive of piezoelectric element inside the pump part 55.

In order to prevent corrosion by the function liquid, the liquid supply tube 203 is made of corrosion resistant fluororesin, polyethylene (PE), polypropylene (PP), or the like. Although the details are given hereinafter, the liquid supply tube 203 is connected to grounding couplings 281 which are disposed in various positions, and is fixed to the apparatus frame 10 by means of each of the couplings. The six liquid supply tubes 203 which extend from the liquid supply tank 203 toward the function liquid droplet ejection head 41 are connected from the Y-axis flexible rack member 123 to T-shaped couplings 284 which are disposed in the coupling unit 272 (to be described in detail hereinafter). They are respectively branched into two to thereby form a total of twelve branch liquid supply tubes 204 (see FIGS. 10, 11 and 13). Each of the branch liquid supply tubes 204 is connected to the respective function liquid droplet ejection heads 41. Each of the branch liquid supply tubes 204 has interposed therein a supply valve 222 and is arranged that the supply of the function liquid to the function liquid droplet ejection heads 41 can be controlled by controlling to open or close the supply valves 222.

The function liquid recovery system 192 is to store the function liquid sucked by the suction unit 131 and is made up of: a reuse tank 231 which stores the sucked function liquid; and a recovery tube 232 which leads the sucked liquid to the reuse tank 231 (see FIG. 13). The recovery tube 232 is also made of a corrosion resistant resin like the liquid supply tube 203. This liquid recovery tube 232 is carried in or supported on the above-described flexible rack member 25. The flexible rack member 25 is fixed to the apparatus base 21 and the front end portion thereof is fixed to the common base 24. It is thus so arranged that the recovery tube 232 follows the movement of the suction unit 131 (common base 24).

The cleaning liquid supply system 193 is to supply the wiping sheet 168 of the wiping unit 132 with the cleaning liquid and is made up of: a cleaning tank 241 which stores therein the cleaning liquid; and a cleaning liquid supply tube 242 which supplies the cleaning liquid inside the cleaning liquid tank 241. As shown in FIG. 13, the cleaning liquid tank 241 has connected thereto: an air supply tube 262 (to be described in detail hereinafter) which is communicated with the air supply means 5; and the cleaning liquid supply tube 242 one end of which is connected to the cleaning liquid spray head 174 of the wiping unit 132. In other words, the cleaning liquid 241 in the cleaning liquid tank 241 is delivered under pressure to the cleaning liquid spray head 174 by means of the compressed air to be introduced from the air supply means 5.

As the cleaning liquid, there is employed a solvent for the function liquid, such as ethanol, or the like. Since there must be used a cleaning liquid corresponding to the function liquid to be introduced, the cleaning liquid supply tube 242 is made, like the liquid supply tube 203, of a corrosion resistant resin such as fluororesin. The cleaning liquid supply tube 242 is supported on or carried in the flexible rack member 25 together with the recovery tube 232 so as to follow the movement of the wiping unit 132 (common base 24).

The waste liquid recovery system 194 is to recover the function liquid ejected to the flushing unit 133 and is made up of: a waste liquid tank 251 which stores therein the recovered function liquid; and a waste liquid tube 252 which is connected to the flushing unit 133 to introduce into the waste liquid tank 251 the function liquid ejected to the flushing unit 133.

A description will now be made about the air supply means 5. As shown in FIG. 13, the air supply means 5 is to supply each part such as the pressurized tank 201, liquid supply tank 202, or the like, with compressed air prepared by compressing an inert gas ($N_2$), and is made up of: an air pump 261 which compresses the inert gas; and an air supply tube 262 which supplies each part with the compressed air as compressed by the air pump 261. The air supply tube 262 has interposed therein a regulator 263 which maintains the pressure to a predetermined pressure depending on where the compressed air is supplied.

Figure 11:
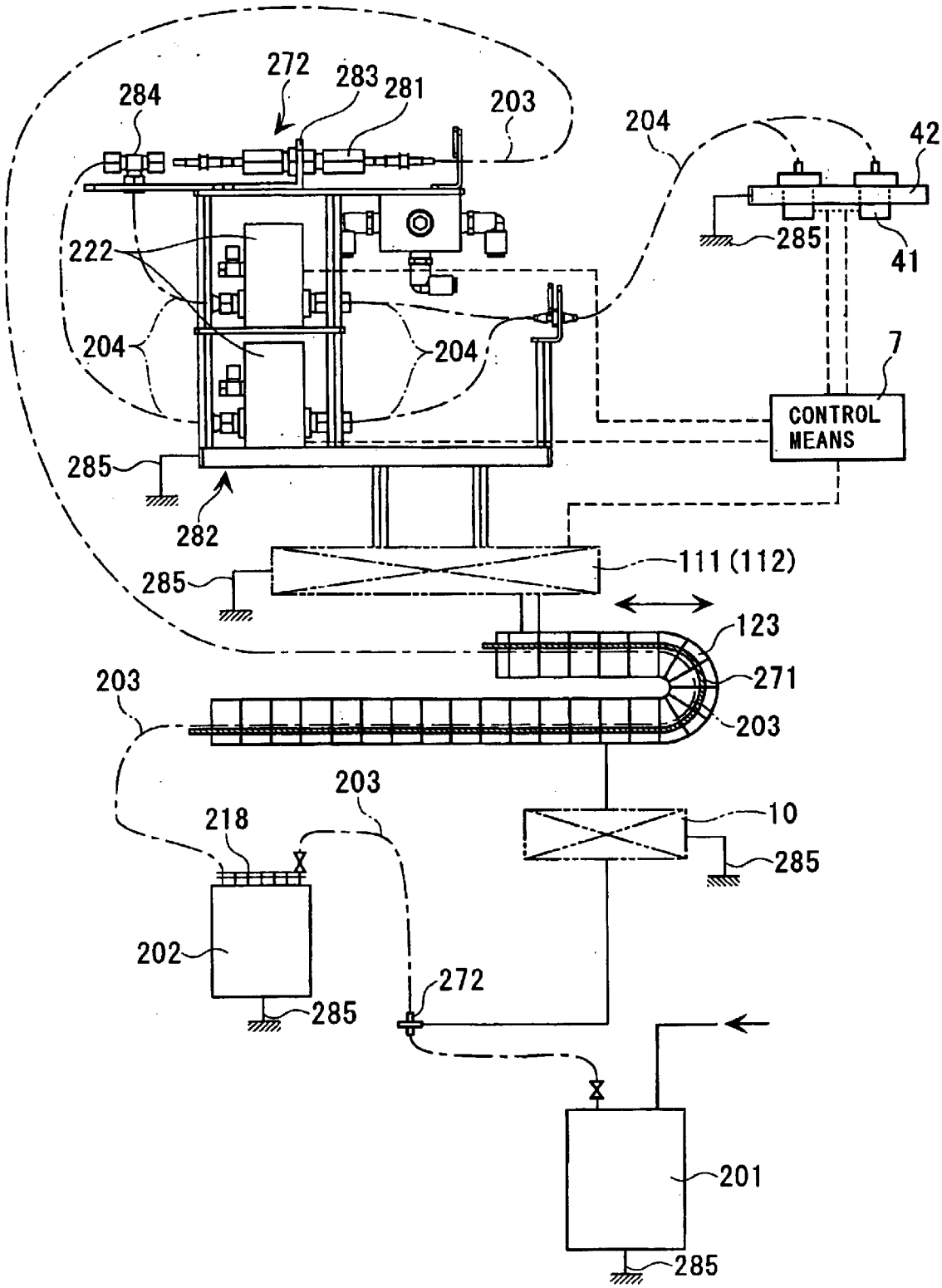
FIG. 11 is a schematic diagram of the grounding means around the liquid supply tube.

A description will then be made about the grounding means 6. The grounding means 6 is to remove or eliminate the static electricity that has been generated mainly in the liquid supply tube 203, recovery tube 232, and cleaning liquid supply tube 242 (the removal of the static electricity is also referred to as static elimination). The grounding means 6 is made up of: a static elimination sheet 271 which eliminates the static electricity generated at the movable portions of each tube, i.e., at the portions carried by the Y-axis flexible rack member 123 and the flexible rack member 25; and a coupling unit 272 which eliminates the static electricity generated at the non-movable portions of each tube, i.e., at the portions except for those carried on the flexible rack members. As shown in FIGS. 11 through 13, each of the tanks, or the like, is connected to the grounding 285 so as to be capable of static elimination. The apparatus frame 10 inclusive of the supporting frame 11, supporting columns 13, apparatus base 21, or the like, is also connected to grounding 285.

Figure 9A:
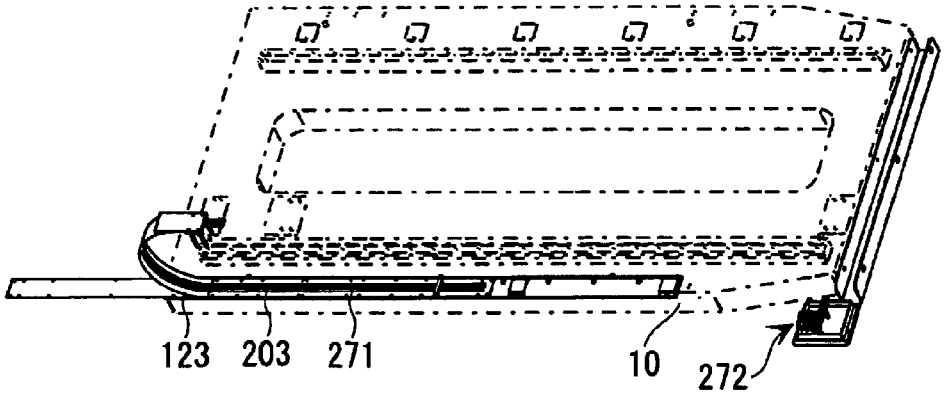
FIG. 9A is an external perspective view around a Y-axis flexible rack member to support a liquid supply tube.
Figure 9B:
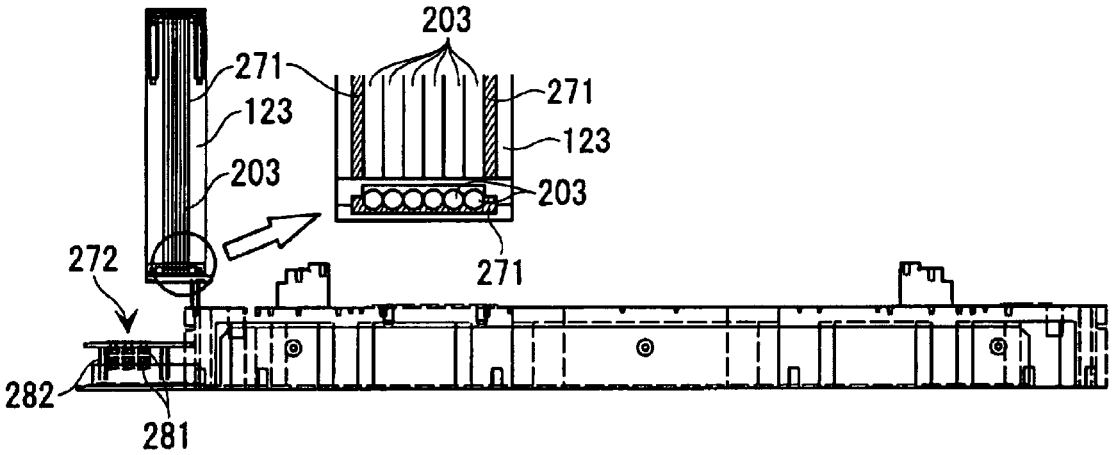
FIG. 9B is a side view thereof.

As shown in FIGS. 9A and 9B, the static elimination sheet 271 is disposed to cover substantially the entire surface of the supporting surface (mounting surface) of the Y-axis flexible rack member 123 and the flexible rack member 25. It is thus so arranged that the static elimination sheet 271 comes into contact with all the tubes that are carried by the Y-axis flexible rack member 123 and the flexible rack member 25. That surface of the static elimination sheet 271 which comes into contact with each of the tubes has formed therein a multiplicity of fine naps (i.e., fine naps are raised on the surface of the static elimination sheet 271) so as to increase the area of contact with the tubes, whereby static elimination can be efficiently performed. Since the static elimination sheet 271 is fixed to the Y-axis flexible rack member 123 and the flexible rack member 25, grounding of the static electricity will thus be made through the apparatus frame 10 by means of the flexible rack members. By disposing the static elimination sheet 271 which comes into contact with the entire lengths of all the supported tubes in a manner to correspond to the lengths of the movable portions of the tubes as well as the widths of the tubes, the effect of the static electricity in those movable portions of each of the tubes which are made of resins and which are most likely to generate the static electricity can be limited to the minimum.

Figure 10A:
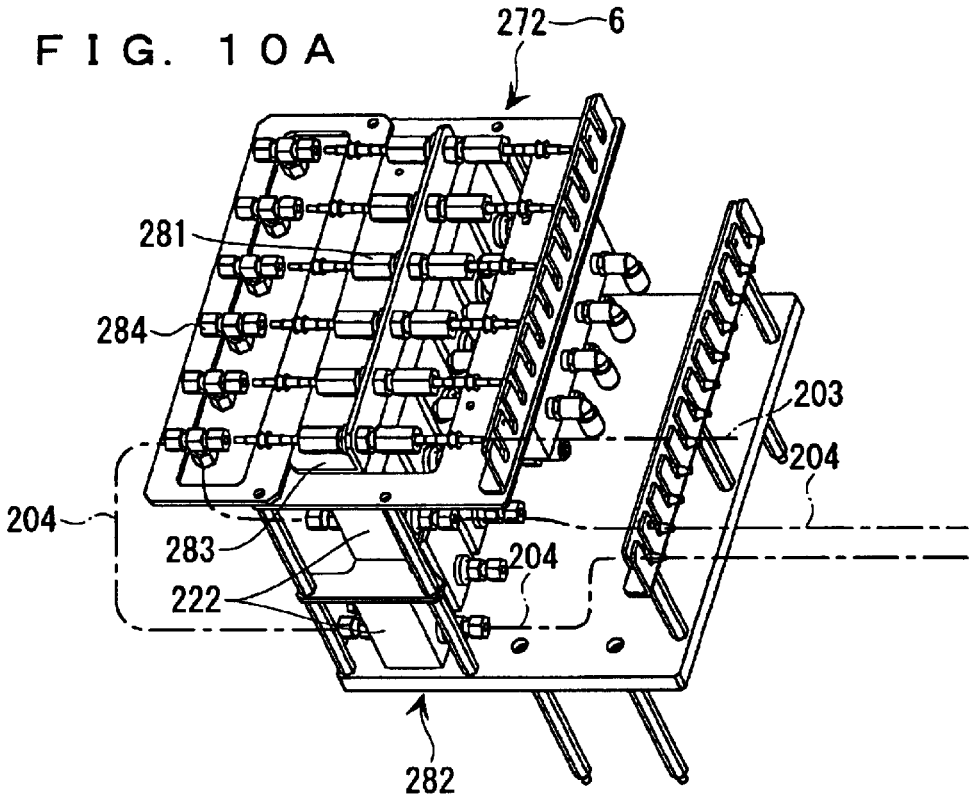
FIG. 10A is an external perspective view of a coupling unit of grounding means and FIG. 10B I a front view thereof.
Figure 10B:
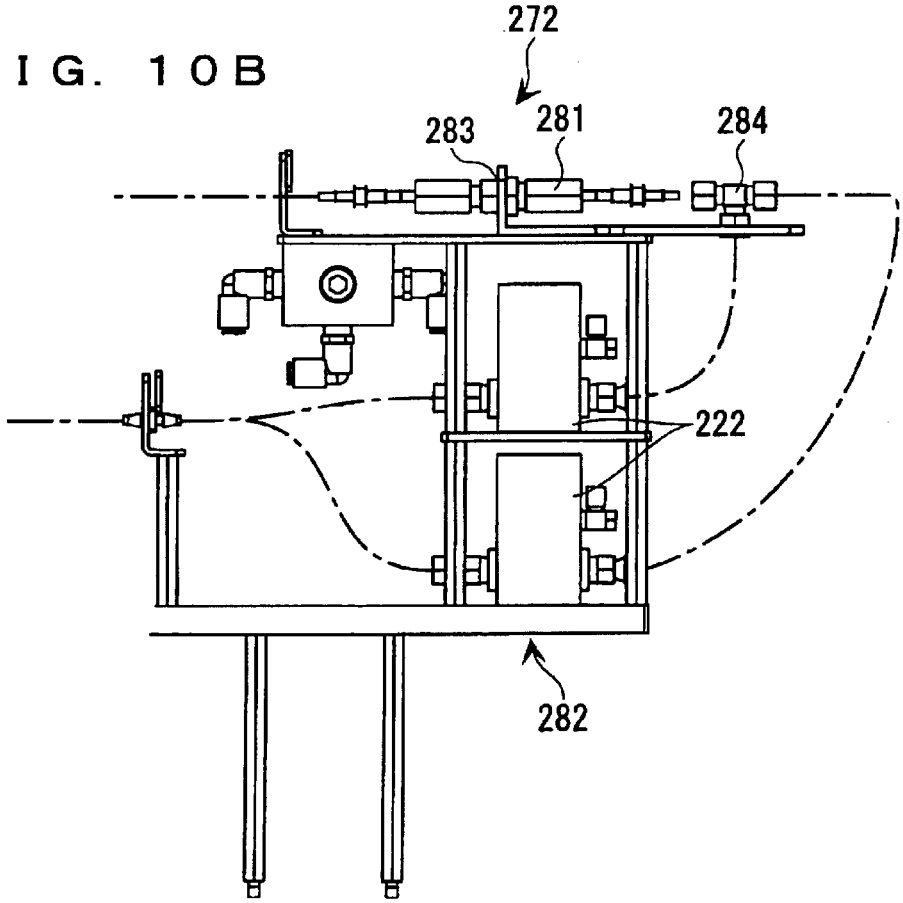

As shown in FIG. 10, the coupling unit 272 is made up of: a grounding coupling 281 which is coupled to each of the tubes; a stand 282 which is used to fix the grounding coupling 281 to the apparatus frame 10; and a coupling fixing member 283 which is used to fix the grounding coupling 281 to the stand 282 and which has an L-shape in cross section (this fixing member is referred to as a coupling fixture member). They are made of an electrically conductive member such as a metal, like copper, brass, or the like, or an electrically conductive resin containing therein electrically conductive material. Each of the tubes in non-movable portions is grounded to the apparatus frame 10 through the grounding coupling 281, the coupling fixture member 283, and the stand 282. It is thus so arranged that the static electricity generated in each of the tubes in the non-moving portions can be eliminated.

With reference to FIGS. 11 and 13, a description will now be made about the grounding means 6 which is disposed around the liquid supply tube 203. The liquid supply tube 203 from the pressurized tank 201 to the function liquid droplet ejection head 41 is about 9.0 meters in length and the movable portion of the liquid supply tube 203 is about 1.2 meters in length. The length from the pressurized tank 201 to the liquid supply tank 202 is about 3.0 meters. As shown in the figure, one coupling unit 272 is interposed in the liquid supply tube 203 in substantially an intermediate portion between the pressurized tank 201 and the liquid supply tank 202, and another coupling unit 272 between the Y-axis flexible rack member 123 (movable portion of the liquid supply tube 203) and the function liquid droplet ejection head 41. Further, the Y-axis flexible rack member 123 is disposed at a position about 1.8 meters from the liquid supply tank 202, and the Y-axis flexible rack member 123 is provided with the static elimination sheet 271 of about 1.2 meters to correspond to the length of the movable portion thereof. The coupling unit 272 which is interposed between the Y-axis flexible rack member 123 and the function liquid droplet ejection head 41 has interposed therein as shown in FIG. 11: a T-shaped coupling 284 for dividing the liquid supply tube 203 into two; and a supply valve 222 which enables to close the branched liquid supply tube 203 (branched liquid supply tube 204).

At the non-movable portion of the liquid supply tube 203, the coupling unit 272 is disposed at every distance of about 1.5–1.8 meters and is grounded through the apparatus frame 10. In other words, by disposing the coupling units 272 at a given interval, the static electricity generated at the non-moving portion of the liquid supply tubes 203 can be appropriately eliminated. The coupling unit 272 to be disposed in the non-moving portions of the liquid supply tubes 203 may, of course, be increased or decreased in number depending on the conditions. In order to more efficiently eliminate the static electricity generated, e.g., at the non-moving portions, the coupling unit 272 may be increased in number so that the coupling units 272 are disposed at every 1.0 meter.

As shown in FIG. 12, in the same manner as around the liquid supply tube 203, the grounding means (static eliminating means) 6 is also disposed around the liquid recovery tube 232 and the cleaning liquid supply tube 242. In other words, depending on the length of the movable portions of the recovery tube 232 and the cleaning liquid supply tube 242, i.e., the portions supported on the above-described flexible rack member 25, the surface to carry or support the tube (supporting surface) of the flexible rack member 25 is provided with a static elimination sheet 271 having fine naps on the surface thereof. In an intermediate position between the reuse tank 231 and the flexible rack member 25 as well as in an intermediate position between the cleaning liquid tank 241 and the flexible rack member 25, there is respectively provided a connector unit 272. It is thus so arranged that the static electricity generated in the non-moving portions of the recovery tube 232 and the cleaning liquid supply tube 242 can be eliminated.

A description will now be made about the control means 7. The control means 7 is connected to each of the means and controls the entire apparatus. The control means 7 is provided with a control part for controlling the operation of each of the means, and the control part stores therein a control program and control data, and has a work region in which various control processing is performed.

A description will now be made about the construction (structure) of, and the method of manufacturing, an electro-optic device (flat panel display) which is manufactured by using the liquid droplet ejection apparatus 1 of this invention. As examples of the electro-optic device, a color filter, a liquid crystal display device, an organic electroluminescence (EL) device, a plasma display panel (PDP) device, an electron emission device (field emission display (FED) device, a surface conduction electron emitter (SED) display), or the like, can be listed. Further, a description will be made about a method of manufacturing an active matrix substrate or the like, as an example, which is formed on the above-described devices. The active matrix substrate is a substrate on which a thin film transistor, as well as source lines and data lines for electrical connection to the thin film transistor are formed.

Figure 14:
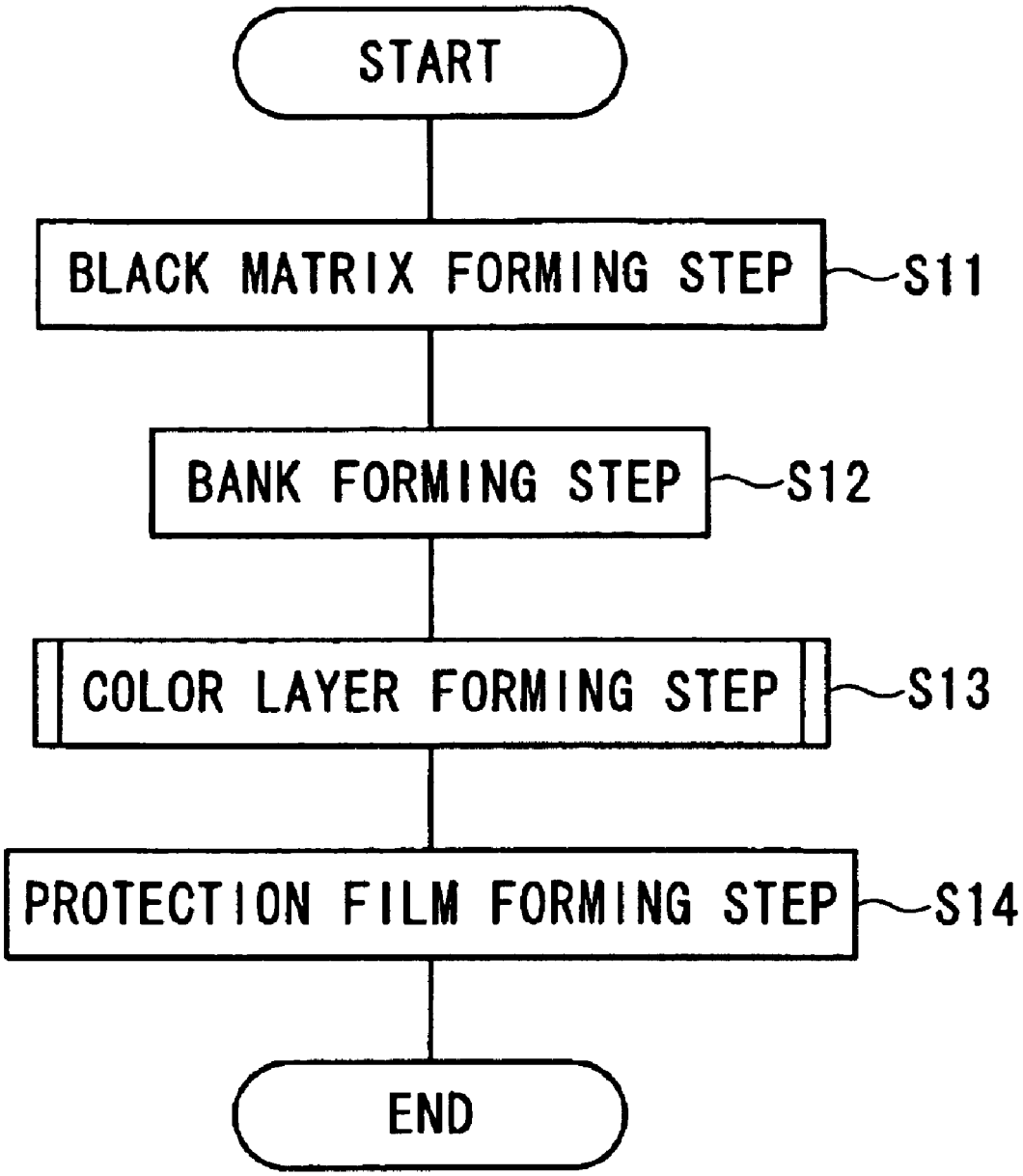
FIG. 14 is a flow chart explaining the manufacturing steps of a color filter.

First, an explanation will be made about the method of manufacturing a color filter which is built or assembled in a liquid crystal display device, an organic EL device, or the like. FIG. 14 is a flow chart showing the manufacturing steps of the color filter, and FIGS. 15A through 15E are schematic cross-sectional views showing the color filter 500 (filter base member 500A) of this embodiment, as shown in the order of manufacturing steps.

Figure 15A:
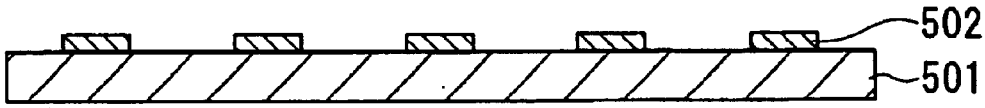
FIGS. 15A–15E are schematic sectional views of a color filter shown in the order of manufacturing steps.

First, at the black matrix forming step (S11), as shown in FIG. 15A, a black matrix 502 is formed on a substrate (W) 501. The black matrix 502 is formed of metallic chrome, a laminated member of metallic chrome and chrome oxide, or of resin black, or the like. In order to form the black matrix 502 made of a metallic thin film, the sputtering method, vapor deposition method, or the like, may be used. In addition, in case the black matrix 502 made of a resin thin film is formed, gravure printing method, photo-resist method, thermal transfer method, or the like, may be used.

Figure 15B:
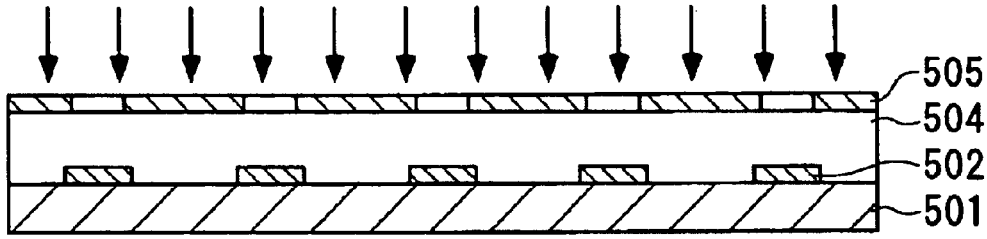

Then, at a bank forming step (S12), a bank 503 is formed in a state of being superimposed on the black matrix 502. In other words, as shown in FIG. 15B, there is formed a resist layer 504 which is made of a negative type of transparent photosensitive resin so as to cover the substrate 501 and the black matrix 502. Then, the upper surface thereof is subjected to exposure processing in a state of being coated with a mask film 505 which is formed in a shape of a matrix pattern.

Figure 15C:
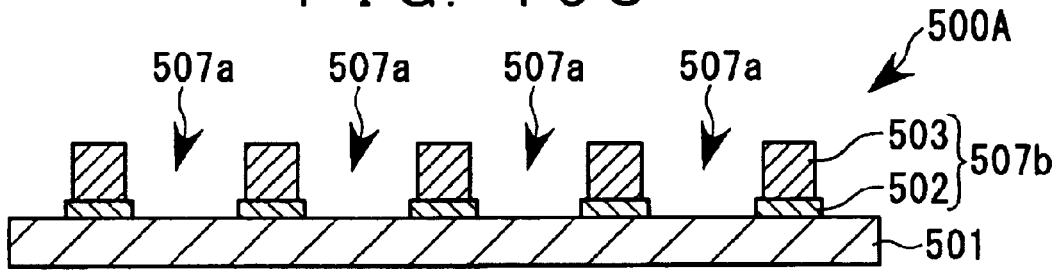

As shown in FIG. 15C, the un-exposed portion of the resist layer 504 is subjected to etching processing to thereby perform patterning of the resist layer 504, to thereby form a bank 503. In case the black matrix is formed by the resin black, it becomes possible to commonly use the black matrix and the bank.

The bank 503 and the black matrix 502 thereunder become a partition wall portion 507*b* which partitions each of pixel regions 507*a*, thereby defining a shooting or firing region by the function liquid droplet (i.e., a region in which the function liquid droplet hits the target) at the subsequent color layer forming step to form the color layers (film forming layers) 508R, 508G, 508B.

By performing the above-described black matrix forming step and the bank forming step, the above-described filter base member 500A can be obtained.

As the material for the bank 503, there is used in this embodiment a resin material whose surface of coated film becomes liquid-repellent (water-repellent). Since the surface of the substrate (glass substrate) 501 has a liquid-affinity (affinity to water), the accuracy of shooting the liquid droplet into each of the pixel regions 507*a* enclosed by the bank 503 (partition wall portion 507*b*) is improved.

Figure 15D:
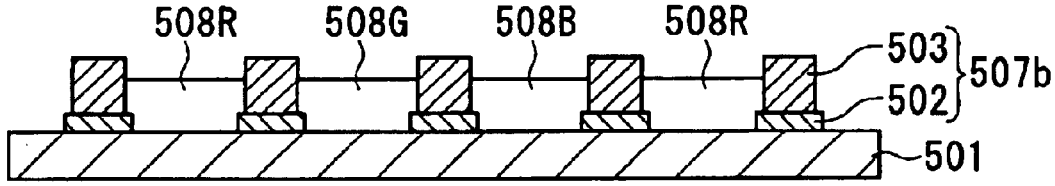

At the subsequent color layer forming step (S13), as shown in FIG. 15D, the function liquid droplet is ejected by the function liquid droplet ejection head 41 to thereby cause the liquid droplet to be shot or fired into each of the pixel regions 507*a* enclosed by the partition wall portion 507*b*. Three colors of red (R), green (G), and blue (B) function liquids (filter materials) are respectively introduced into these three function liquid droplet ejection heads 10, to thereby eject the function liquid droplets. As the arrangement pattern of three colors of R-G-B, there are stripe arrangement, mosaic arrangement, delta arrangement, or the like.

Figure 15E:
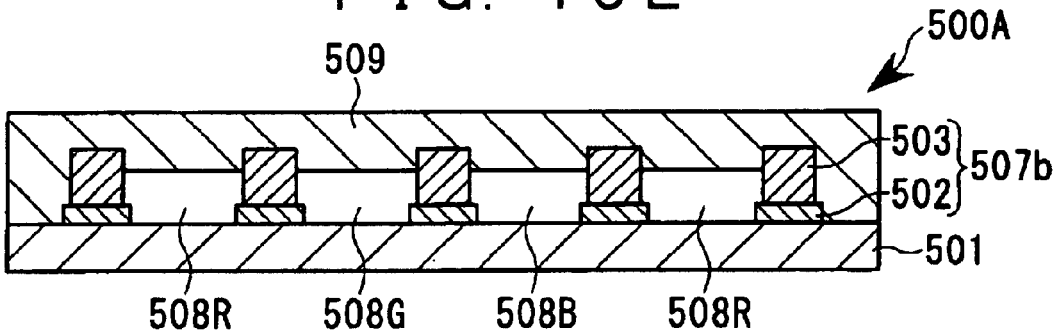

Thereafter, after drying processing (processing of heating, or the like), the function liquid is caused to be fixed to thereby form color layers 508R, 508G, 508B of three colors. Once the color layers have been formed, the step transfers to the protection film forming step (S14). As shown in FIG. 15E, a protection film 509 is formed to cover the upper surface of the substrate 501, the partition wall portion 507*b*, and color layers 508R, 508G, 508B.

In other words, after having ejected the protection film coating liquid over that entire surface of the substrate 501 on which the color layers 508R, 508B, 508G are formed, the protection film 509 is formed through the drying step.

After having formed the protection film 509, the color filter 500 transfers to the subsequent film-forming step to form an indium tin oxide (ITO) film which becomes the transparent film at the subsequent step.

Figure 16:
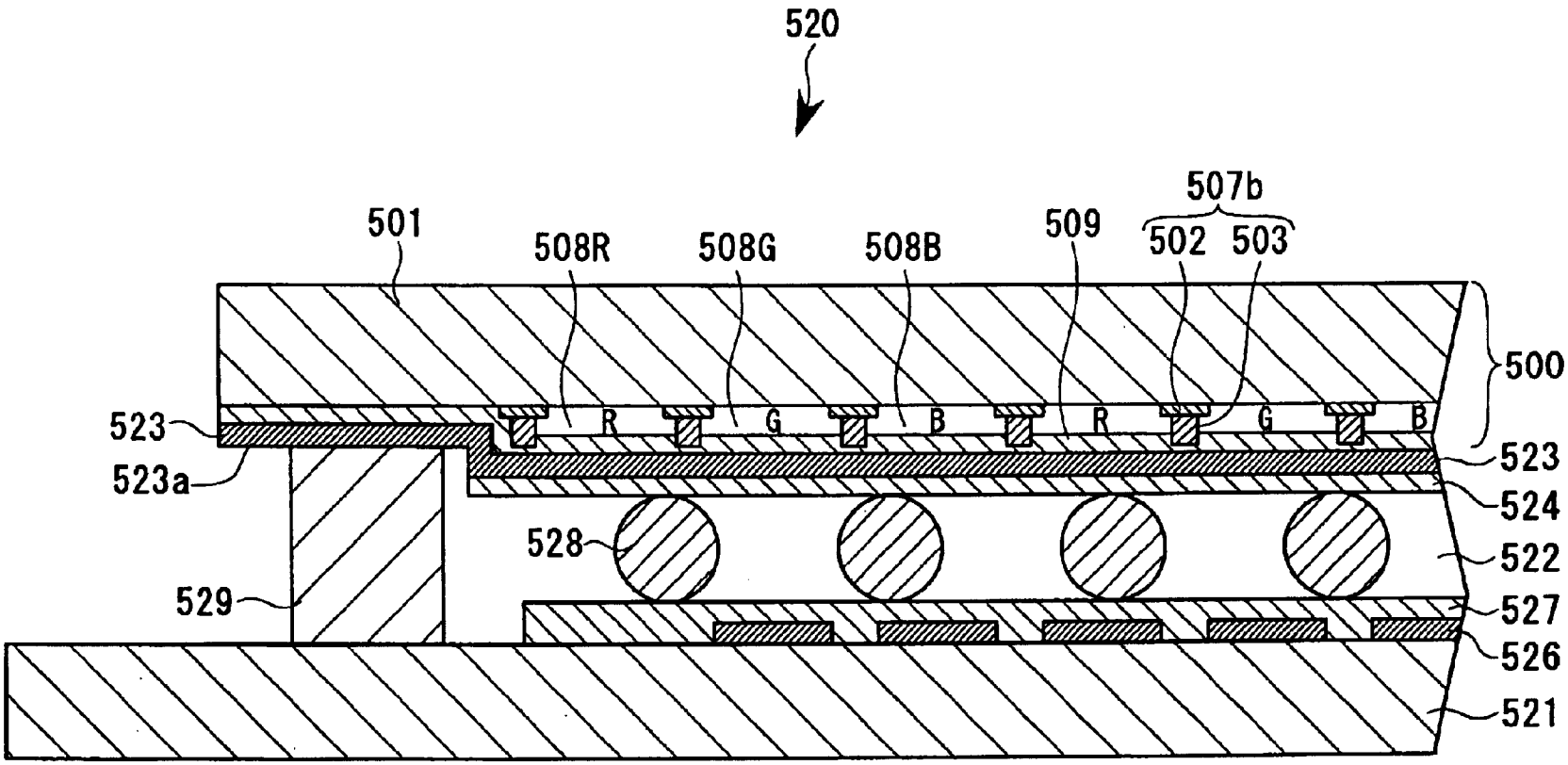
FIG. 16 is a sectional view of an important portion showing a general arrangement of a liquid crystal device using a color filter to which this invention is applied.

FIG. 16 is a sectional view of an important portion showing a general structure of passive matrix type of liquid crystal device (liquid crystal device) as an example of a liquid crystal display device employing the above-described color filter 500. By mounting auxiliary elements such as a liquid crystal driving integrated circuit (IC), backlight, supporting member, or the like, on this liquid crystal device 520, there is obtained a transmission liquid crystal display device as a final product. The color filter 500 is the same as that shown in FIG. 15. Therefore, the same reference numerals are affixed to the corresponding parts/portions and the explanation thereabout is omitted.

This liquid crystal device 520 is made up substantially of: a color filter 500; an opposite substrate 521 made of a glass substrate, or the like; and a liquid crystal layer 522 which is made up of a super twisted nematic (STN) liquid crystal composition interposed therebetween. The color filter 500 is disposed on an upper side as seen in the figure (i.e., on a side from which the viewer looks at the color filter).

Although not illustrated, on an outside surface of the opposite substrate 521 and of the color filter 500 (i.e., the surface which is opposite to the liquid crystal layer 522), there is respectively disposed a polarizer. On an outside of the polarizer which is positioned on the side of the opposite electrode 521, there is disposed a backlight.

On the protection film 509 (on the side of the liquid crystal) of the color filter 500, there are disposed a plurality of rectangular first electrodes 523 which are elongated in the left and right direction as seen in FIG. 16. A first alignment layer 524 is formed so as to cover that side of the first electrode 523 which is opposite to the color filter 500.

On that surface of the opposite substrate 521 which lies opposite to the color filter 500, a plurality of second electrodes 526 are formed at a given distance to one another in a direction at right angles to the first electrode 523. A second alignment layer 527 is formed so as to cover that surface of the second electrode 526 which is on the side of the liquid crystal layer 522. The first electrode 523 and the second electrode 526 are formed by a transparent conductive material such as ITO, or the like.

The spacer 528 which is provided inside the liquid crystal layer 522 is a material to keep the thickness of the liquid crystal layer 522 (cell gap) constant. The sealing material 529 is a material to prevent the liquid crystal composition inside the liquid crystal layer 522 from leaking outside. One end of the first electrode 523 is extended to the outside of the sealing material 529 as a running cable 523*a*.

The crossing portions between the first electrode 523 and the second electrode 526 are the pixels. It is thus so arranged that the color layers 508R, 508G, 508B of the color filter 500 are positioned in these portions which form the pixels.

At the ordinary manufacturing steps, the color filter 500 is coated with the patterning of the first electrode 523 and the first alignment layer 524, to thereby form the portion on the side of the color filter 500. Aside from the above, the opposite substrate 521 is coated with the patterning of the second electrode 526 and the second alignment layer 527, to thereby form the portion on the side of the opposite substrate 521. Thereafter, the spacer 528 and the sealing material 529 are formed into the portion on the side of the opposite substrate 521, and the portion on the side of the color filter 500 is adhered to the above-described portion in that state. Then, the liquid crystal which forms the liquid crystal layer 522 is filled from an inlet port, and the inlet port is closed thereafter. Thereafter, both the polarizers and the backlight are laminated.

In the liquid droplet ejection apparatus 1 of this embodiment, the spacer material (function liquid) which forms, e.g., the cell gap is coated. And, before the portion on the side of the color filter 500 is adhered to the portion on the side of the opposite substrate 521, the liquid crystal (function liquid) is uniformly coated on the region enclosed by the sealing material 529. Further, the coating of both the first and second alignment layers 524, 527 may alternatively be performed by the function liquid droplet ejection head 41.

Figure 17:
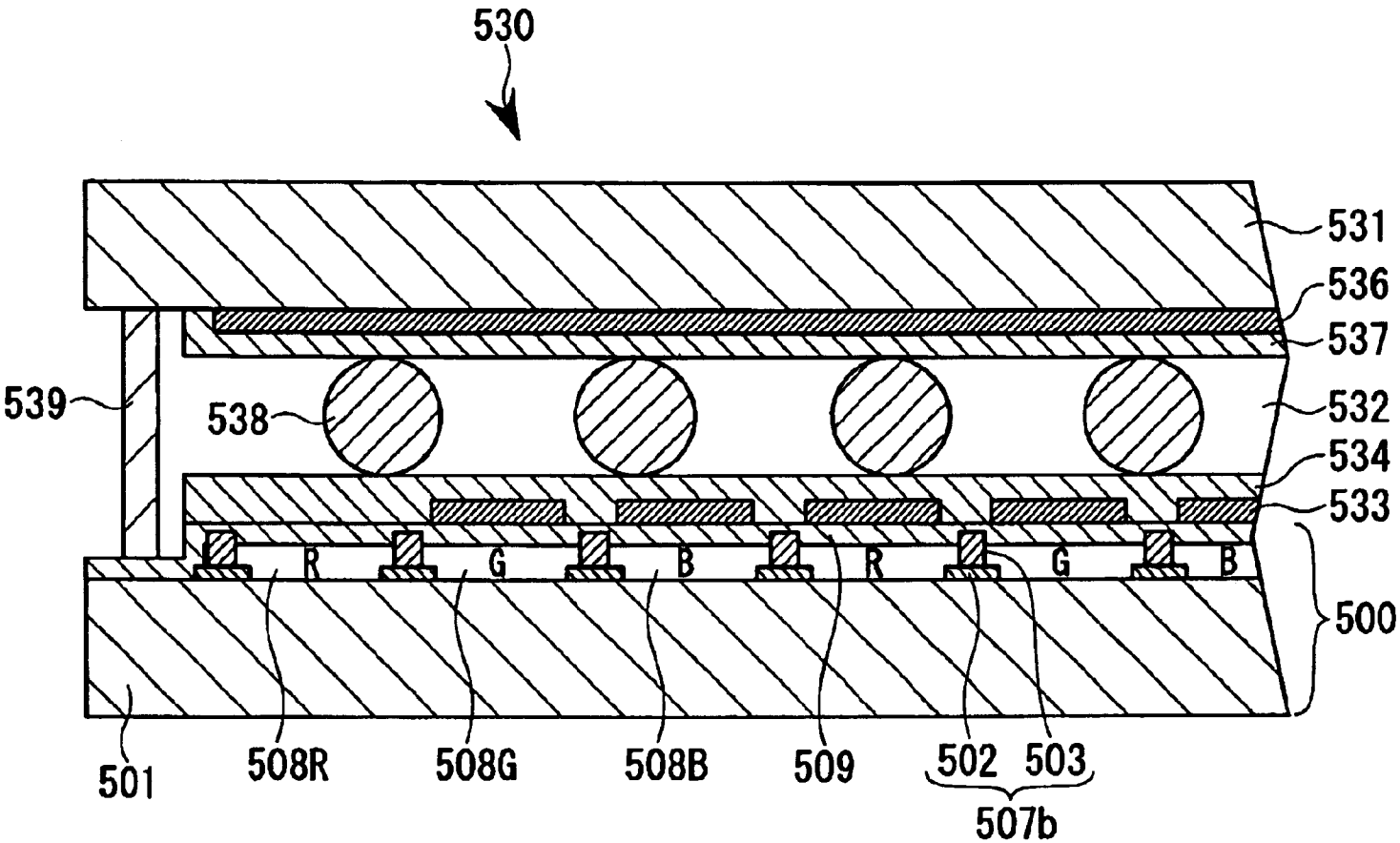
FIG. 17 is a sectional view of an important portion showing a general arrangement of a second example of a liquid crystal device using a color filter to which this invention is applied.

FIG. 17 is a sectional view of an important portion showing a general structure of liquid crystal device using a color filter 500 manufactured in this embodiment.

What this liquid crystal device 530 is largely different from the above-described liquid crystal device 520 is that the color filter 500 is disposed on the lower side as seen in the figure (i.e., on the side opposite to the side from which the viewer looks at the device).

This liquid crystal device 530 is constructed such that a liquid crystal layer 532 which is made of an STN liquid crystal is sandwiched between the color filter 500 and the opposite substrate 531 which is made by a glass substrate, or the like. Though not illustrated, a polarizer, or the like, is disposed on an outside surface of the opposite substrate 531 and the color filter 500, respectively.

On the protection film 509 (on the side of the liquid crystal layer 532) of the color filter 500, there are disposed a plurality of rectangular first electrodes 533 which are elongated in a direction at right angles to the surface of the figure (FIG. 17). A first alignment layer 534 is formed so as to cover that side of the first electrode 533 which is on the side of the liquid crystal layer 532.

On that surface of the opposite substrate 531 which lies opposite to the color filter 500, a plurality of second electrodes 536 are formed at a given distance to one another in a direction at right angles to the first electrode 533. A second alignment layer 537 is formed so as to cover that surface of the second electrode 536 which is on the side of the liquid crystal layer 532.

The liquid crystal layer 532 is provided with a spacer 538 to keep the thickness of the liquid crystal layer 532 constant, and a sealing material 539 to prevent the liquid crystal composition inside the liquid crystal 532 layer from leaking outside.

In the same manner as in the above-described liquid crystal device 520, the crossing portions between the first electrode 533 and the second electrode 536 are the pixels. It is thus so arranged that the color layers 508R, 508G, 508B of the color filter 500 are positioned in these portions which form the pixels.

Figure 18:
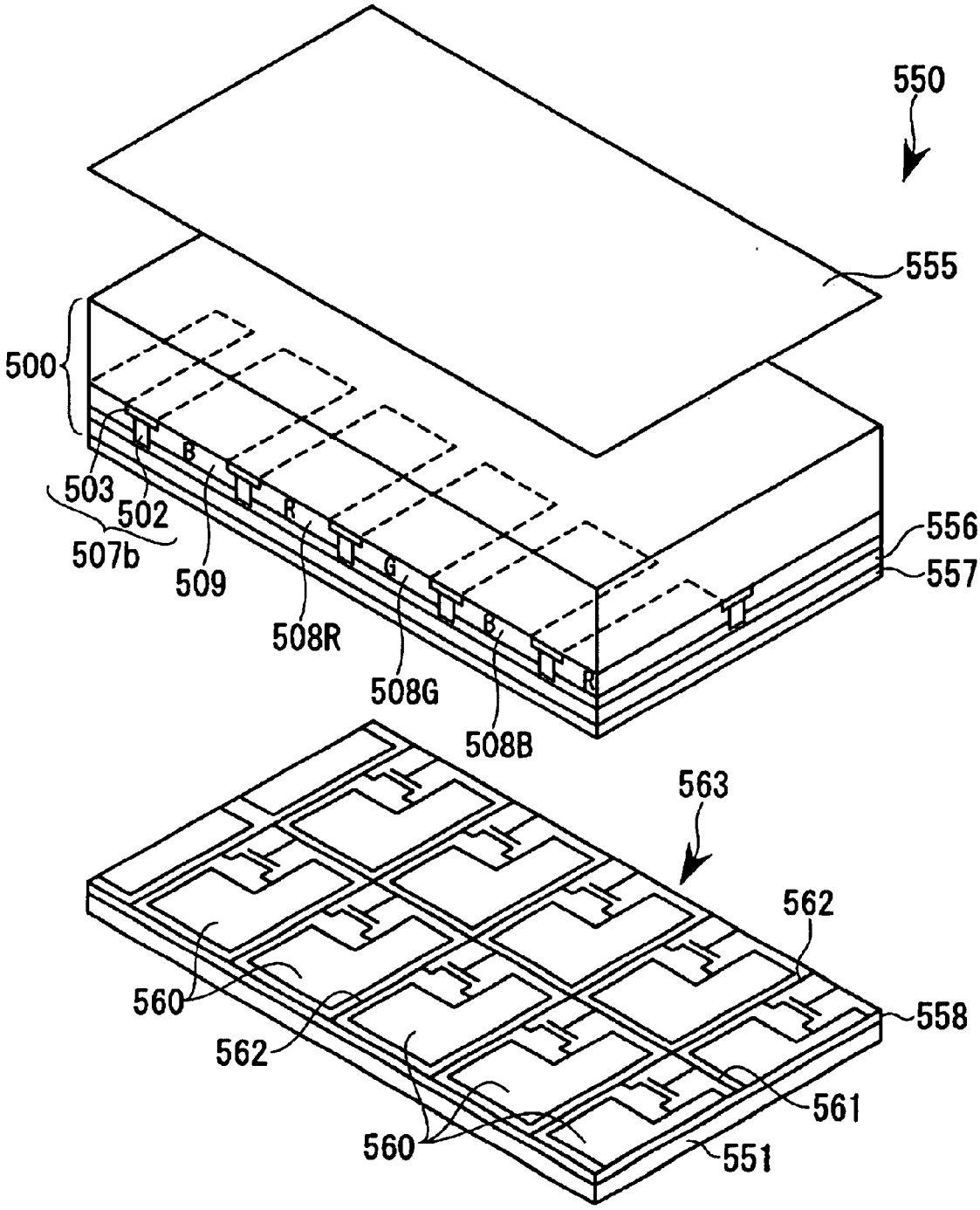
FIG. 18 is an exploded perspective view of an important portion showing a general arrangement of a third example of a liquid crystal device using a color filter to which this invention is applied.

FIG. 18 is an exploded perspective view of an important portion showing a general structure of a transmission thin film transistor (TFT) type of liquid crystal device using a color filter 500 to which this invention is applied.

This liquid crystal device 550 has a construction in which the color filter 500 is disposed on an upper side as seen in the figure (i.e., on the side of the viewer).

This liquid crystal device 550 is made up of: the color filter 500; an opposite substrate 551 which is disposed to lie opposite to the color filter 500; a liquid crystal layer which is sandwiched therebetween; a polarizer 555 which is disposed on an upper side (on the side of the viewer) of the color filter 500; and a polarizer (not illustrated) which is disposed on the lower side of the opposite electrode 551.

On the surface (i.e., the surface on the side of the opposite substrate 551) of a protection film 509 of the color filter 500, there is formed an electrode 556 for the liquid crystal driving. This electrode 556 is made of a transparent conductive material such as an ITO, or the like, and is formed into an entire-surface electrode which covers the entire region in which the pixel electrodes 560 (to be described later) are formed. An alignment layer 557 is disposed in a state of covering the opposite surface of this pixel electrodes 560 of the electrode 556.

On that surface of the opposite substrate 551 which lies opposite to the color filter 500, there is formed an insulating layer 558. On this insulating layer 558 there are formed scanning lines 561 and signal lines 562 in a state of crossing each other at right angles. Pixel electrodes 560 are formed inside the regions enclosed by the scanning lines 561 and the signal lines 562. In the actual liquid crystal device, there will be disposed an alignment layer (not illustrated) on the pixel electrode 560.

In the notched portion of the pixel electrode 560 and in the portion which is enclosed by the scanning line 561 and the signal line 562, there are built in or assembled a thin film transistor which is provided with a source electrode, a drain electrode, a semiconductor, and a gate electrode. By charging signals to the scanning line 561 and the signal line 562, the thin film transistor 563 can be switched on and off so as to control the supply of electric current to the pixel electrode 560.

Although the above-described liquid crystal devices 520, 530, 550 of each of the above examples is constituted into a transmission type, it may also be constituted into a reflective type of liquid crystal device or into a translucent reflective type of liquid crystal device by providing a reflective layer or a translucent reflective layer, respectively.

Figure 19:
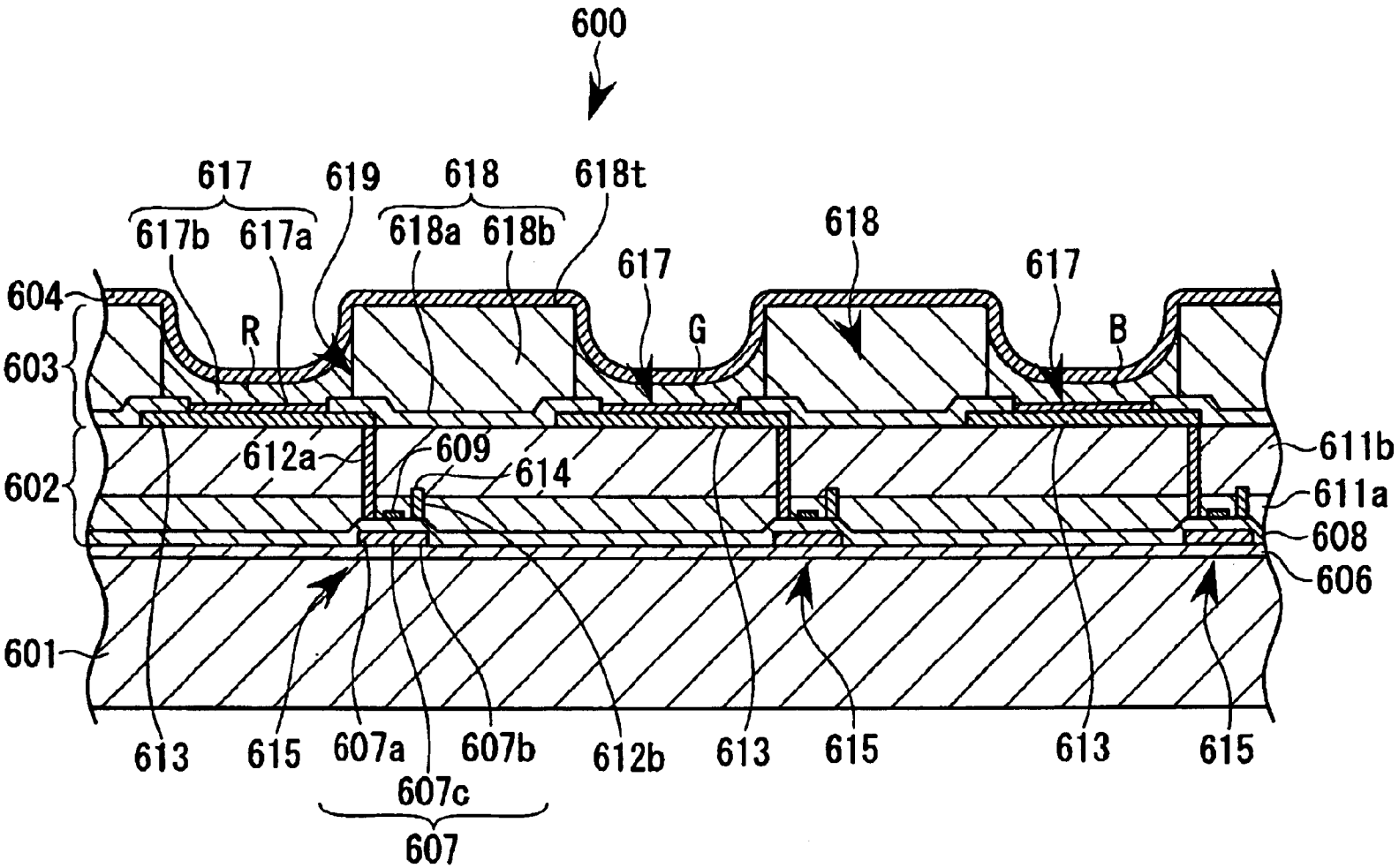
FIG. 19 is a sectional view of an important portion of a display device according to a second embodiment of this invention.

FIG. 19 is a sectional view of an important part of a display region of an organic EL device (hereinafter referred to as a display device 600).

This display device 600 is substantially constituted by a substrate 601 (W), and on this substrate are laminated a circuit element part 602, light-emitting element part 603 and a cathode 604.

In this display device 600, the light emitted from the light-emitting element part 603 toward the substrate 601 is transmitted through the circuit element part 602 and the substrate 601. The light emitted from the light-emitting element part 603 toward the side opposite to the substrate 601 is reflected by the cathode 604 and passes through the circuit element part 602 and the substrate 601 for ejection toward the viewer.

Between the circuit element part 602 and the substrate 601, there is formed a base protection film 606 which is made of a silicon oxide film. On top of this base protection film 606 (on the side of the light-emitting element 603), there is formed an island shaped semiconductor film 607 which is made of polycrystalline silicon. In the left and right regions of this semiconductor film 607, there are respectively formed a source region 607*a* and a drain region 607*b* by high-concentration anion implantation. The central portion which is free from anion implantation becomes a channel region 607*c*.

In the circuit element part 602, there is formed a transparent gate insulation film 608 which covers the base protection film 606 and the semiconductor film 607. In that position on this gate insulation film 608 which corresponds to the channel region 607*c* of the semiconductor film 607, there is formed a gate electrode 609 which is made up of Al, Mo, Ta, Ti, W, or the like. On top of this gate electrode 609 and the gate insulation film 608, there are formed a transparent first interlayer insulator (interlayer dielectric film) 611*a* and a second interlayer insulator 611*b*. Through the first and second interlayer insulators 611*a*, 611*b*, there are formed contact holes 612*a*, 612*b* which are in communication with the source region 607*a* and the drain region 607*b*, respectively, of the semiconductor film 607.

On top of the second interlayer insulator 611*b*, there is formed, by patterning, a transparent pixel electrode 613 which is made of ITO, or the like. This pixel electrode 613 is connected to the source region 607*a* through the contact hole 612*a*.

On top of the first interlayer insulator 611*a*, there is formed an electric source wiring 614, which is connected to the drain region 607*b* through the contact hole 612*b*.

As described hereinabove, the circuit element part 602 has formed therein a driving thin film transistor 615 which is connected to each of the pixel electrodes 613.

The above-described light-emitting element part 603 is made up of: a function layer 617 which is laminated on each of the plurality of pixel electrodes 613; and a bank part 618 which is provided between each of the pixel electrodes 613 and the function layers 617 to thereby partition each of the function layers 617.

The light-emitting element is constituted by these pixel electrodes 613, the function layer 617, and the cathode 604 which is disposed on the function layer 617. The pixel electrode 613 is formed into a substantial rectangle as seen in plan view, and the bank part 618 is formed between each of the pixel electrodes 613.

The bank part 618 is made up of: an inorganic-matter bank layer 618*a* (first bank layer) which is formed by inorganic materials such as SiO, $SiO_2$, $TiO_2$, or the like; and an organic-matter bank layer 618*b* (second bank layer) which is trapezoidal in cross section and which is formed by a resist superior in heat-resistance and solvent-resistance such as an acrylic resin, a polyimide resin, or the like. Part of this bank part 618 is formed in a state of being overlapped with the peripheral portion of the pixel electrode 613.

Between each of the bank parts 618, there is formed an opening part 619 which gradually enlarges towards an upward.

The function layer 617 is made up of: a hole injection/transport layer 617*a* which is formed inside the opening part 619 in a state of being laminated on the pixel electrode 613; and a light-emitting layer 617*b* which is formed on this hole injection/transport layer 617*a*. It may be so arranged that other function layers having other functions are further formed adjacent to the light-emitting layer 617*b*. For example, an electron transport layer may be formed.

The hole injection/transport layer 617*a* has a function of transporting holes from the pixel electrode 613 side for injection into the light-emitting layer 617*b*. This hole injection/transport layer 617*a* is formed by ejecting the first composition of matter (function liquid) containing therein the hole injection/transport layer forming material. As the hole injection/transport layer forming material, there may be used a known material.

The light-emitting layer 617*b* emits light of red (R), green (G) or blue (B), and is formed by ejecting the second composition of matter (function liquid) containing the light-emitting layer forming material (light-emitting material). As the solvent (non-polar solvent) for the second composition of matter, it is preferable to use a known material which is insoluble to the hole injection/transport layer 617*a*. By using this kind of non-polar solvent as the second composition of matter of the light-emitting layer 617*b*, the light-emitting layer 617*b* can be formed without dissolving the hole injection/transport layer 617*a* again.

The light-emitting layer 617*b* is so arranged that the holes injected from the hole injection/transport layer 617*a* and the electron injected from the cathode 604 get bonded again in the light-emitting layer to thereby emit light.

The cathode 604 is formed in a state to cover the entire surface of the light-emitting element part 603, and forms a pair with the pixel electrode 613 to thereby cause the electric current to flow through the function layer 617. A sealing member (not illustrated) is disposed on top of this cathode 604.

Then, a description will be made about the manufacturing steps of the display device 600 with reference to FIGS. 20 through 24.

Figure 20:
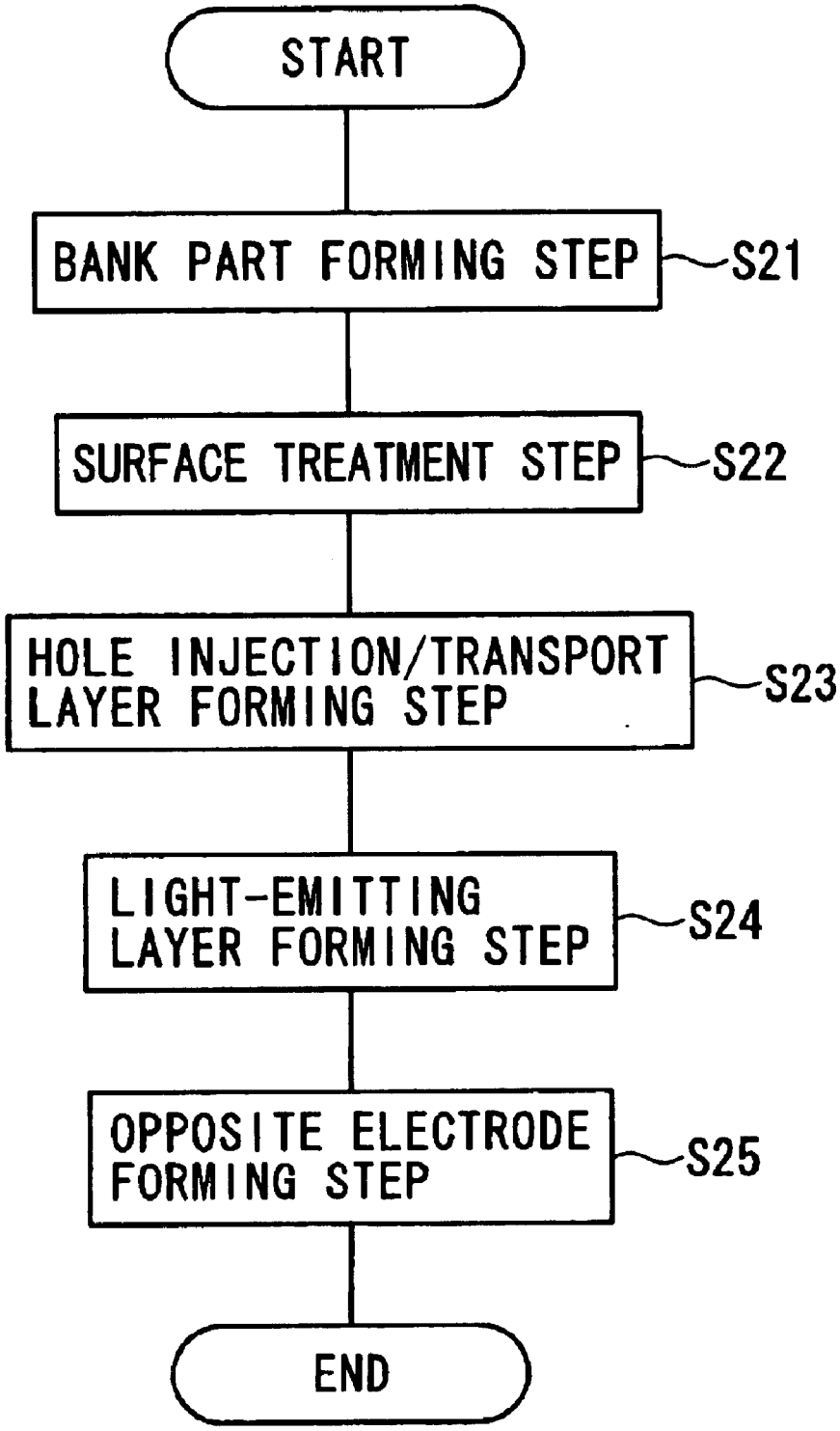
FIG. 20 is a flow chart explaining the manufacturing steps of a display device which is an organic electroluminescence (EL) device.

As shown in FIG. 20, this display device 600 is manufactured through the following steps, i.e., a bank part forming step (S21), a surface treatment step (S22), a hole injection/transport layer forming step (S23), a light-emitting layer forming step (S24), and an opposite electrode forming step (S25). The manufacturing steps need not be limited to the illustrated ones; some steps may be omitted or others added if necessary.

Figure 21:
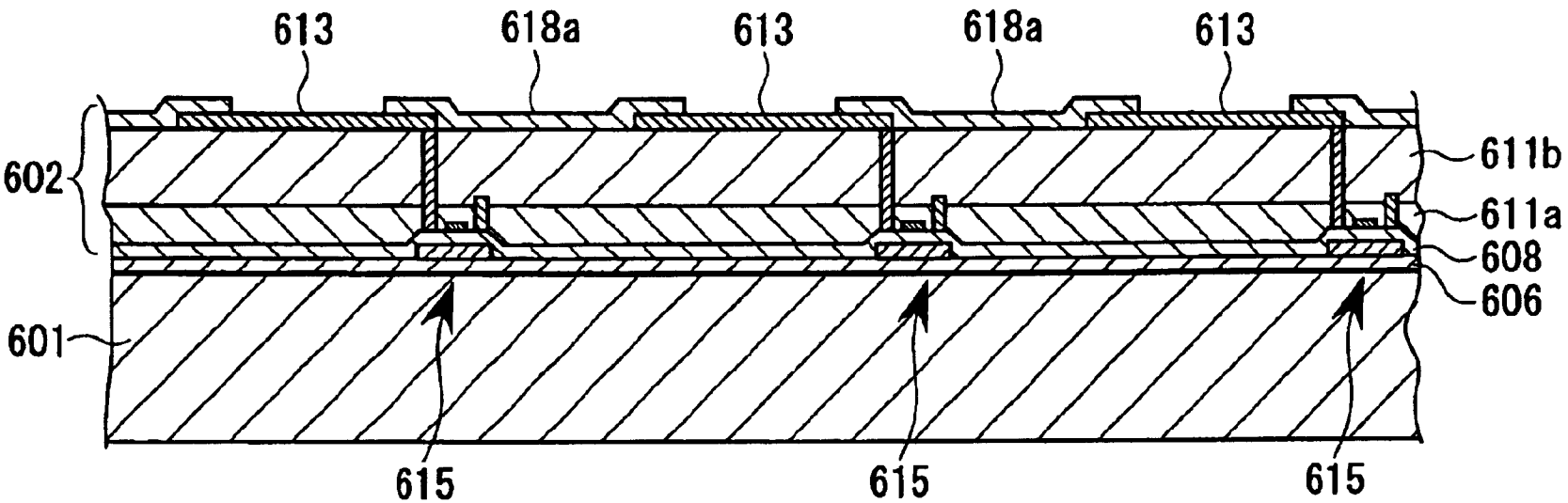
FIG. 21 is a manufacturing step diagram explaining the forming of an inorganic-matter bank layer.

First, at the bank part forming step (S21), an inorganic-matter bank layer 618*a* is formed on the second interlayer insulator 611*b* as shown in FIG. 21. This inorganic-matter bank layer 618*a* is formed, after having formed an inorganic-matter film on the forming position, by patterning the inorganic-matter film by means of photolithography, or the like. At this time, part of the inorganic-matter bank layer 618*a* is formed so as to overlap with the peripheral portion of the pixel electrode 613.

Figure 22:
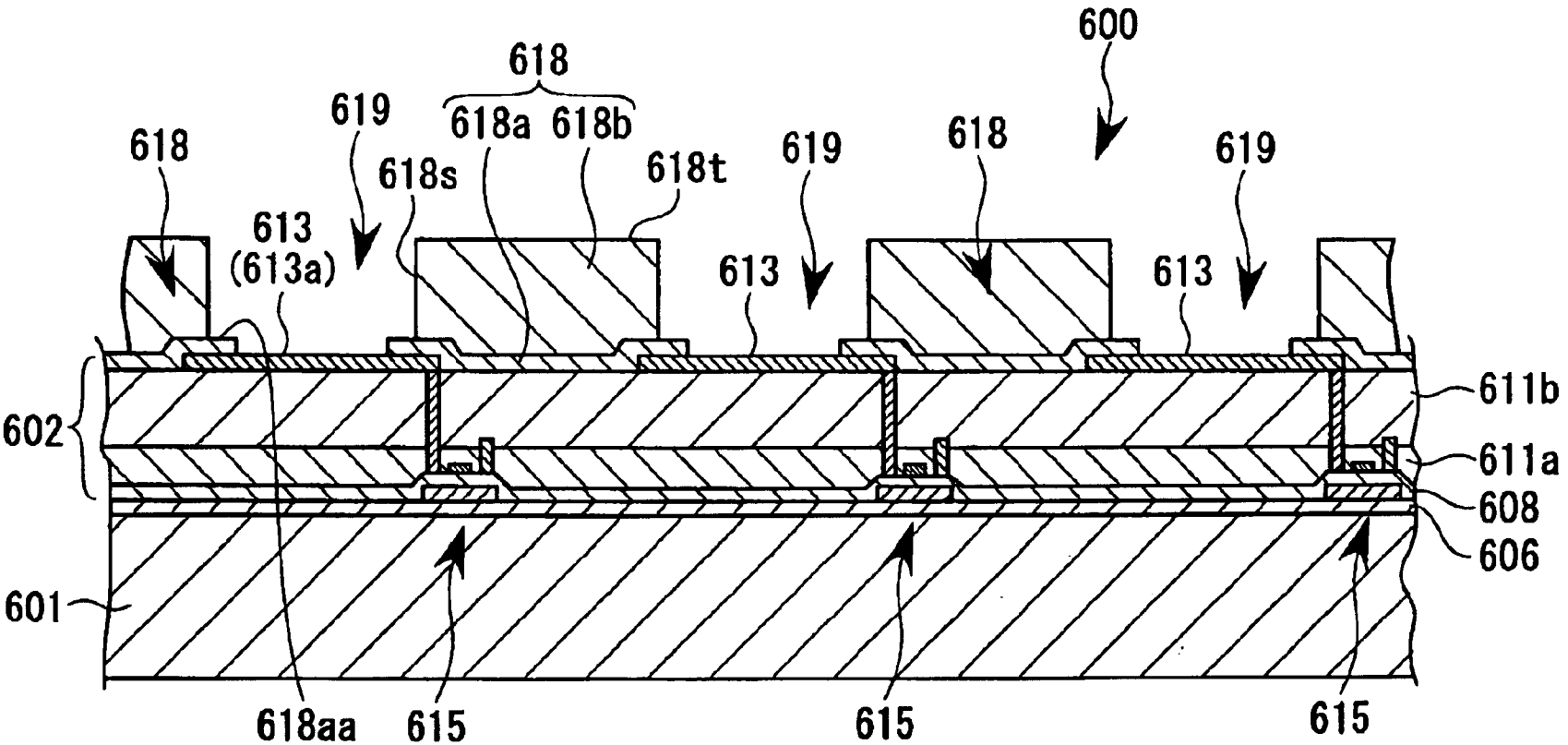
FIG. 22 is a manufacturing step diagram explaining the forming of an organic-matter bank layer.

Once the inorganic-matter bank layer 618*a* has been formed, an organic-matter bank layer 618*b* is formed on top of the inorganic-matter bank layer 618*a* as shown in FIG. 22. This organic-matter bank layer 618*b* is formed, as in the case of the inorganic-matter bank layer 618*a*, by patterning by means of photolithography, or the like.

The bank part 618 is formed as described above. As a result, an opening part 619 which opens upward relative to the pixel electrode 613 is formed. This opening part 619 defines a pixel region.

At the surface treatment step (S22), the liquid-affinity processing (treatment to gain affinity to liquid) and the liquid-repellency processing (treatment to gain repellency to liquid) are performed. The region in which the liquid-affinity processing is to be performed are the first laminated part 618*aa* of the inorganic-matter bank layer 618*a* and the electrode surface 613*a* of the pixel electrode 613. These regions are subjected to surface treatment to obtain liquid affinity by means, e.g., of plasma processing using oxygen as the processing gas. This plasma processing also serves the purpose of cleaning the ITO which is the pixel electrode 613.

The liquid-repellency processing, on the other hand, is performed on the wall surface 618*s* of the organic-matter bank layer 618*b* and on the upper surface 618*t* of the organic-matter bank layer 618*b*. By means of plasma processing with, e.g., methane tetrafluoride as the processing gas, the surface is subjected to fluoridizing processing (processed to obtain liquid-repellent characteristic).

By performing this surface processing step, it becomes possible for the function liquid droplet to reach (or hit) the pixel region in a surer manner when the function layer 617 is formed by using the function liquid droplet ejection head 10. It also becomes possible to prevent the function liquid droplet that has hit the pixel region from flowing out of the opening part 619.

By going through the above-described steps, the display device base member 600A can be obtained. This display device base member 600A is mounted on the setting table 25 of the liquid droplet ejection apparatus 1 as shown in FIG. 1, and the following hole injection/transport layer forming step (S23) and the light-emitting layer forming step (S24) are performed.

Figure 23:
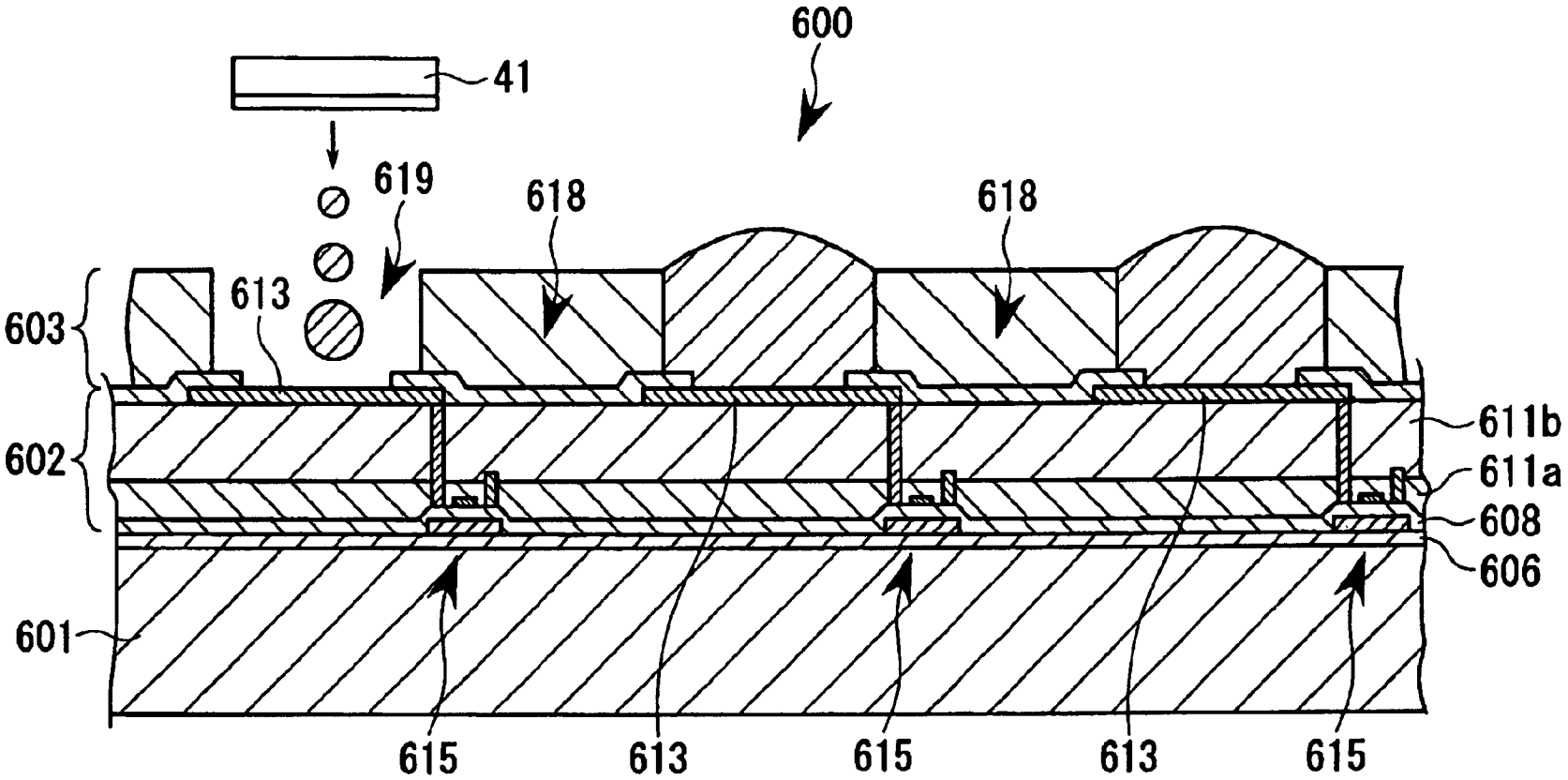
FIG. 23 is a manufacturing step diagram explaining the forming of a hole injection/transport layer.
Figure 24:
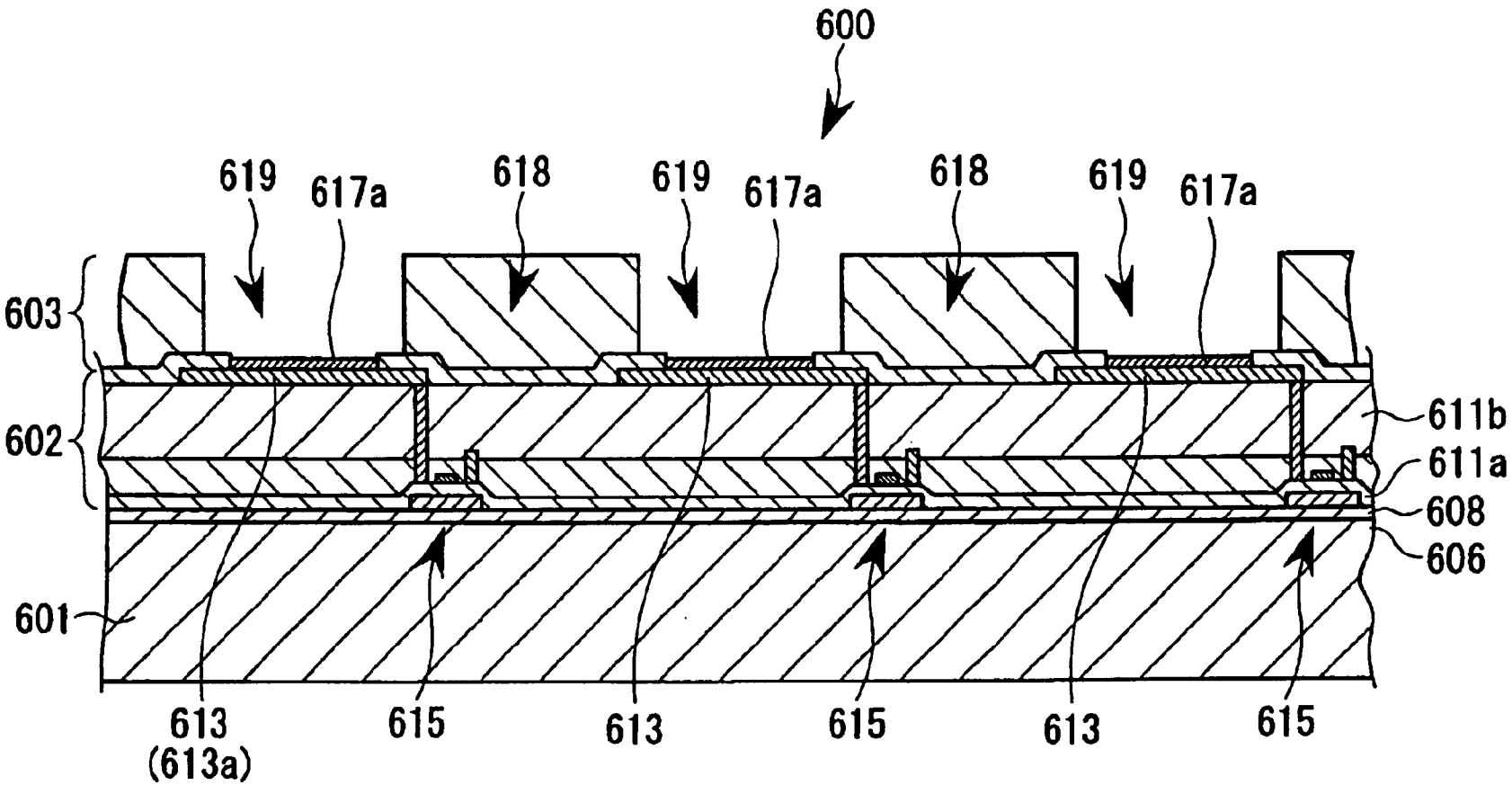
FIG. 24 is a manufacturing step diagram explaining the state in which the hole injection/transport layer has been formed.

As shown in FIG. 23, at the hole injection/transport layer forming step (S23), the first composition of matter containing therein the hole injection/transport layer forming material is ejected from the function liquid droplet ejection head 10 into each of the opening parts 619. Thereafter, as shown in FIG. 24, drying process and heat-treatment process are performed in order to evaporate the polar solvent contained in the first composition of matter, whereby the hole injection/transport layer 617*a* is formed on the pixel electrode (electrode surface 613*a*) 613.

A description will now be made about the light-emitting layer forming step (S24). At this light-emitting layer forming step, as described above, in order to prevent the hole injection/transport layer 617*a* from getting resolved again, there is used a non-polar solvent which is insoluble to the hole injection/transport layer 617*a* as a solvent for the second composition of matter to be used in forming the light-emitting layer.

On the other hand, since the hole injection/transport layer 617*a* is low in affinity to the non-polar solvent, it will be impossible to closely adhere the hole injection/transport layer 617*a* to the light-emitting layer 617*b* or to uniformly coat the light-emitting layer 617*b* even if the second composition of matter containing therein the non-polar solvent is ejected onto the hole injection/transport layer 617*a*.

As a solution, in order to enhance the affinity of the surface of the hole injection/transport layer 617*a* to the non-polar solvent and to the light-emitting layer forming material, it is preferable to perform the surface treatment (treatment to improve the quality of the surface) before forming the light-emitting layer. This surface treatment is performed by coating the hole injection/transport layer 617*a* with a solvent which is the same as, or similar to, the non-polar solvent of the second composition of matter to be used in forming the light-emitting layer, and then drying it.

By performing this kind of treatment, the surface of the hole injection/transport layer 617*a* easily conforms to the non-polar solvent. It becomes thus possible to uniformly coat, at a subsequent step, the hole injection/transport layer 617*a* with the second composition of matter containing therein the light emitting layer forming material.

Figure 25:
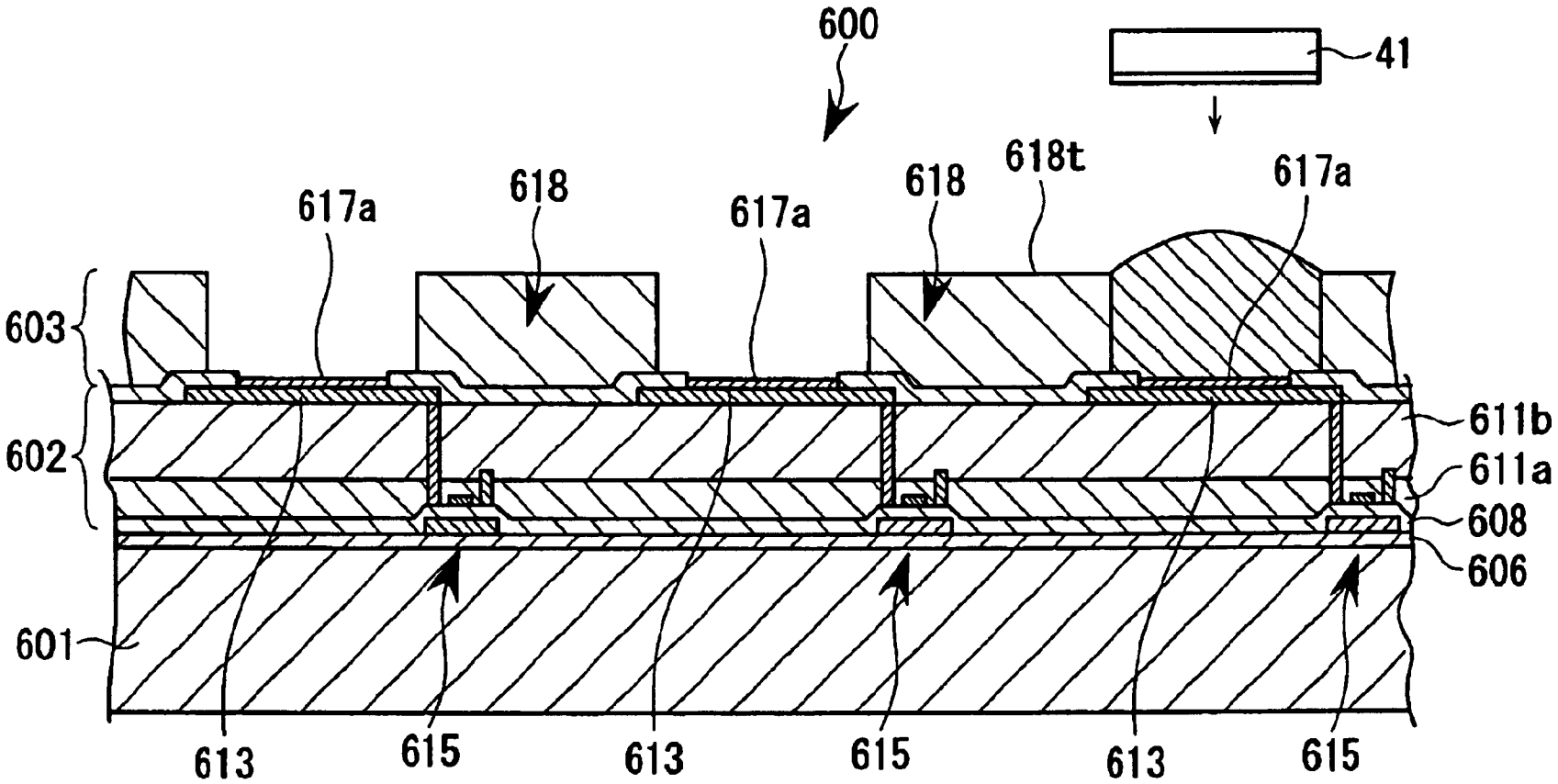
FIG. 25 is a manufacturing step diagram explaining the forming of a blue light-emitting layer.

Thereafter, as shown in FIG. 25, the second composition of matter containing therein the light emitting layer forming material corresponding to one of the colors (blue in the example in FIG. 25) is implanted into the pixel region (opening part 619) by a predetermined amount. The second composition of matter implanted into the pixel region gets spread over the hole injection/transport layer 617*a* to thereby fill the opening part 619. Even if the second composition of matter goes out of the pixel region to thereby hit the upper surface 618*t* of the bank part 618, this upper surface 618*t* has been subject to the liquid-repellent treatment as described above. Therefore, the second composition of matter is likely to be easily rolled into the opening part 619.

Figure 26:
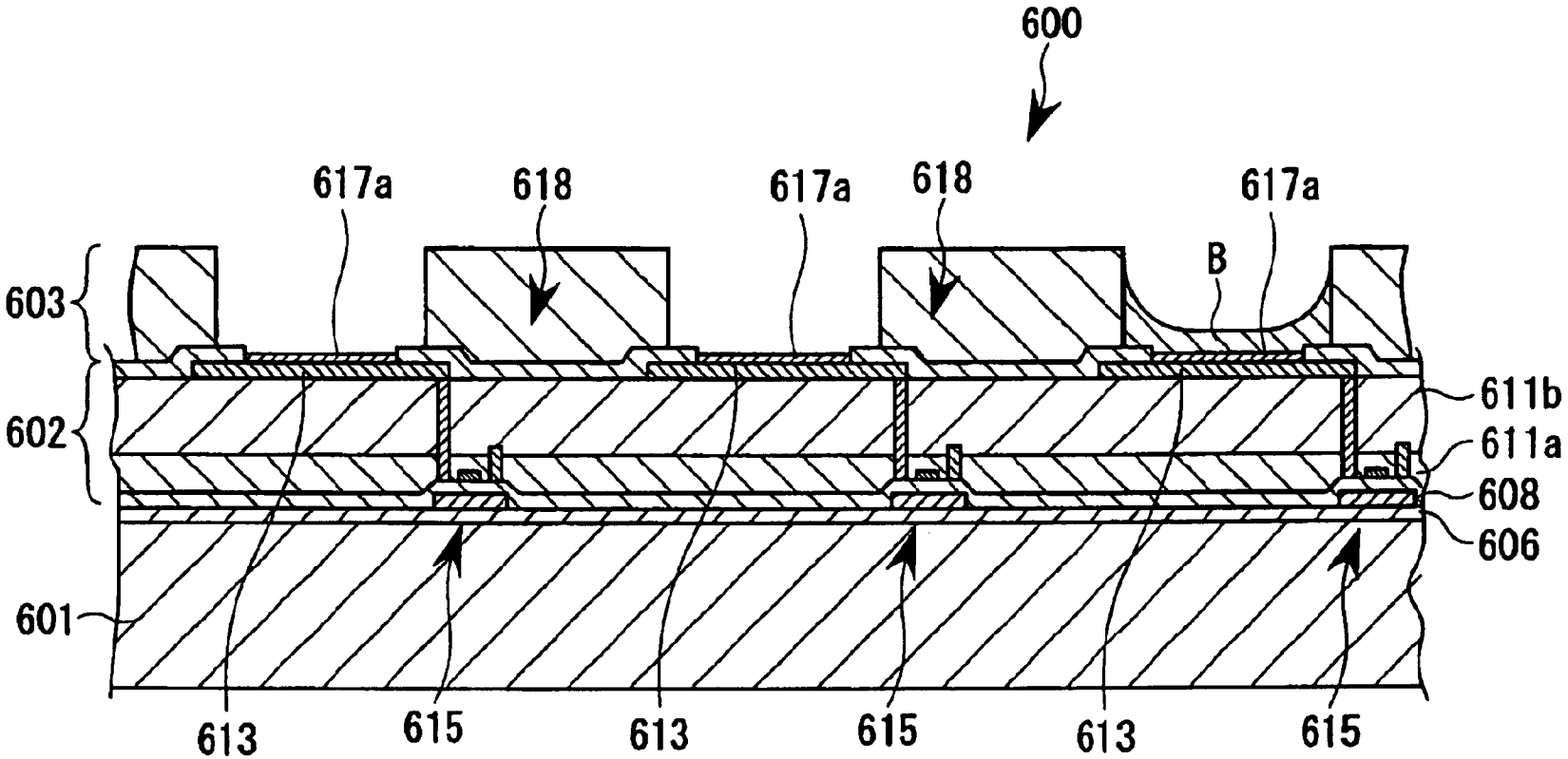
FIG. 26 is a manufacturing step diagram explaining the state in which the blue light-emitting layer has been formed.

Thereafter, by performing the drying step, or the like, the second composition of matter after ejection is processed by drying to thereby evaporate the non-polar solvent contained in the second composition of matter. The light-emitting layer 617*b* is thus formed on top of the hole injection/transport layer 617*a* as shown in FIG. 26. In this example, there is formed a light-emitting layer 617*b* corresponding to the blue color (B).

Figure 27:
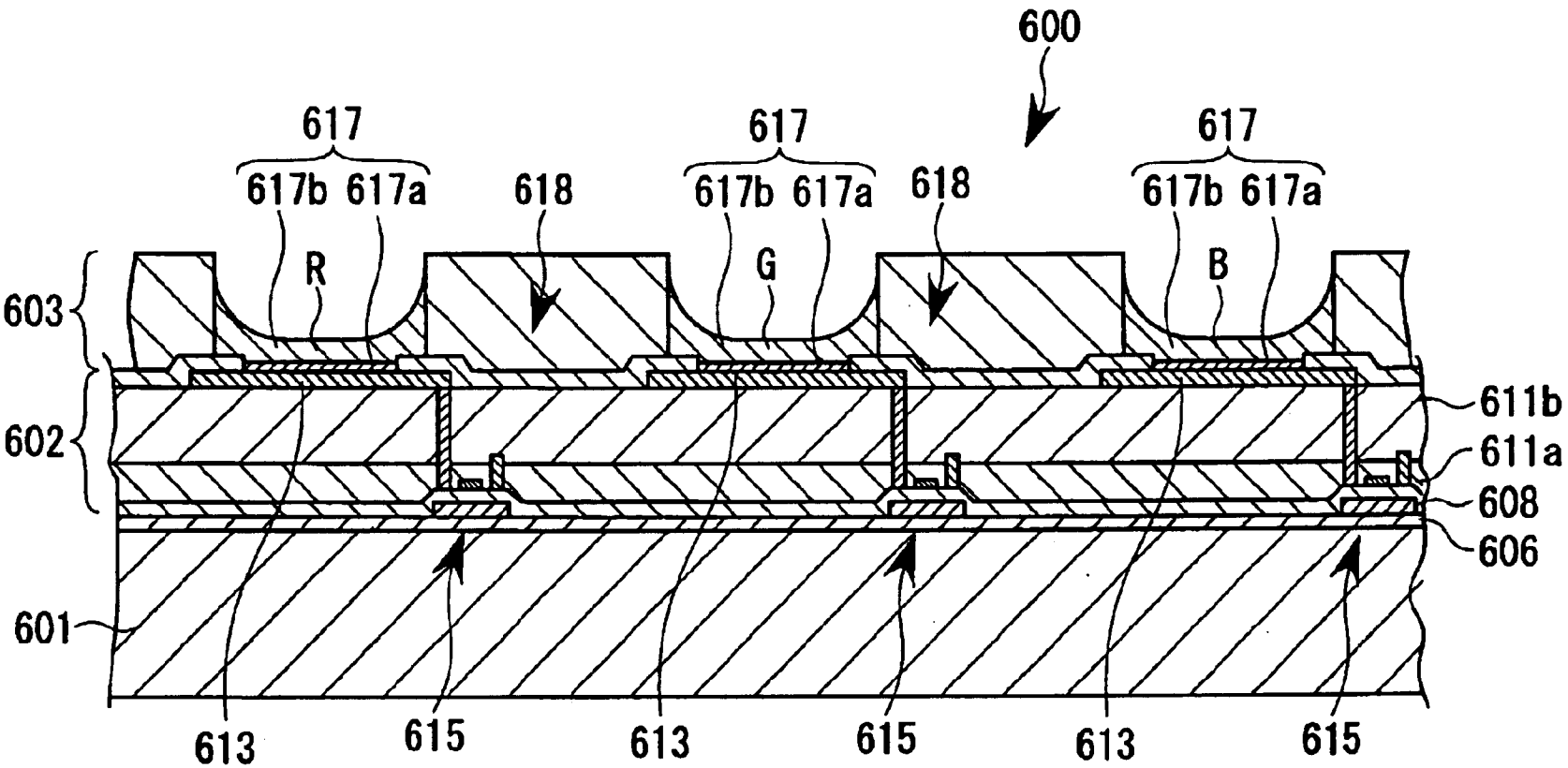
FIG. 27 is a manufacturing step diagram explaining the state in which the light-emitting layer of each color has been formed.

By using the function liquid droplet ejection head 41, the steps like in the above-described light-emitting layer 617*b* corresponding to the blue color (B) are sequentially performed as shown in FIG. 27, whereby the light-emitting layers 617*b* corresponding to the other colors of red (R) and green (G) are formed. The order of forming the light-emitting layer 617*b* is not limited to the above-described example, but may be arbitrarily determined. For example, it is possible to determine the order of forming depending on the materials to form the light-emitting layer. The arrangement pattern of the three colors of R, G, B may be of a stripe arrangement, a mosaic arrangement, delta arrangement, or the like.

In the manner as described hereinabove, the function layer 617, i.e., the hole injection/transport layer 617*a* and the light-emitting layer 617*b*, is formed on the pixel electrode 613. Then, the process transfers to the opposite electrode forming step (S25).

Figure 28:
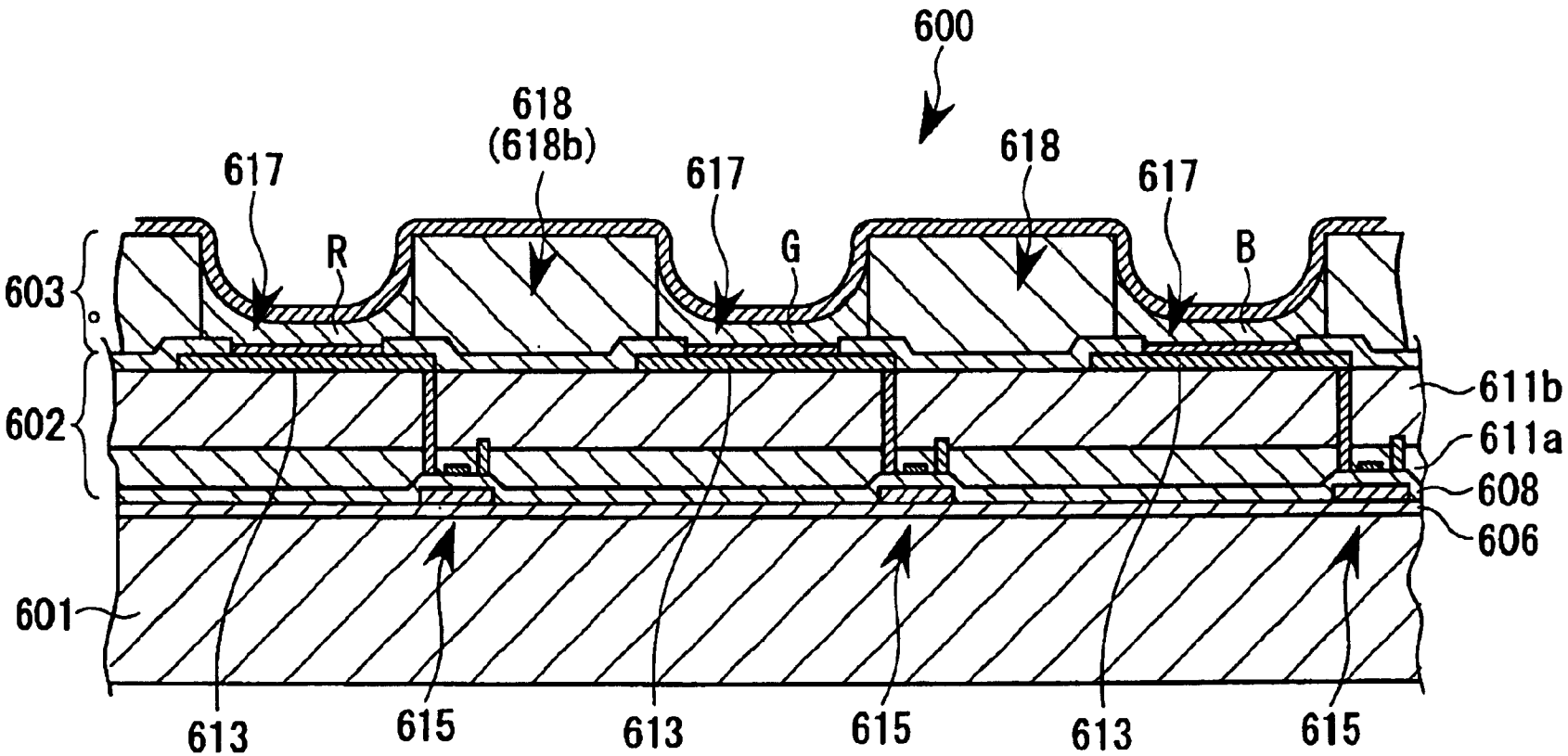
FIG. 28 is a manufacturing step diagram explaining the forming of a cathode.

At the opposite electrode forming step (S25), as shown in FIG. 28, the cathode 604 (opposite electrode) is formed over the entire surfaces of the light-emitting layer 617*b* and the organic matter bank layer 618*b* by means of vapor deposition method, sputtering method, chemical vapor deposition (CVD) method, or the like. This cathode 604 is constituted in this embodiment by laminating, e.g., a calcium layer and an aluminum layer.

On an upper part of the cathode 604, there are provided an Al film and an Ag film as electrodes and, on top thereof, a protection film for preventing oxidation such as an $SiO_2$ film, an SiN film, or the like.

After having formed the cathode 604 as described above, a sealing process for sealing the upper portion of the cathode 604 with a sealing material, a wiring processing, or the like, are performed to thereby obtain the display device 600.

Figure 29:
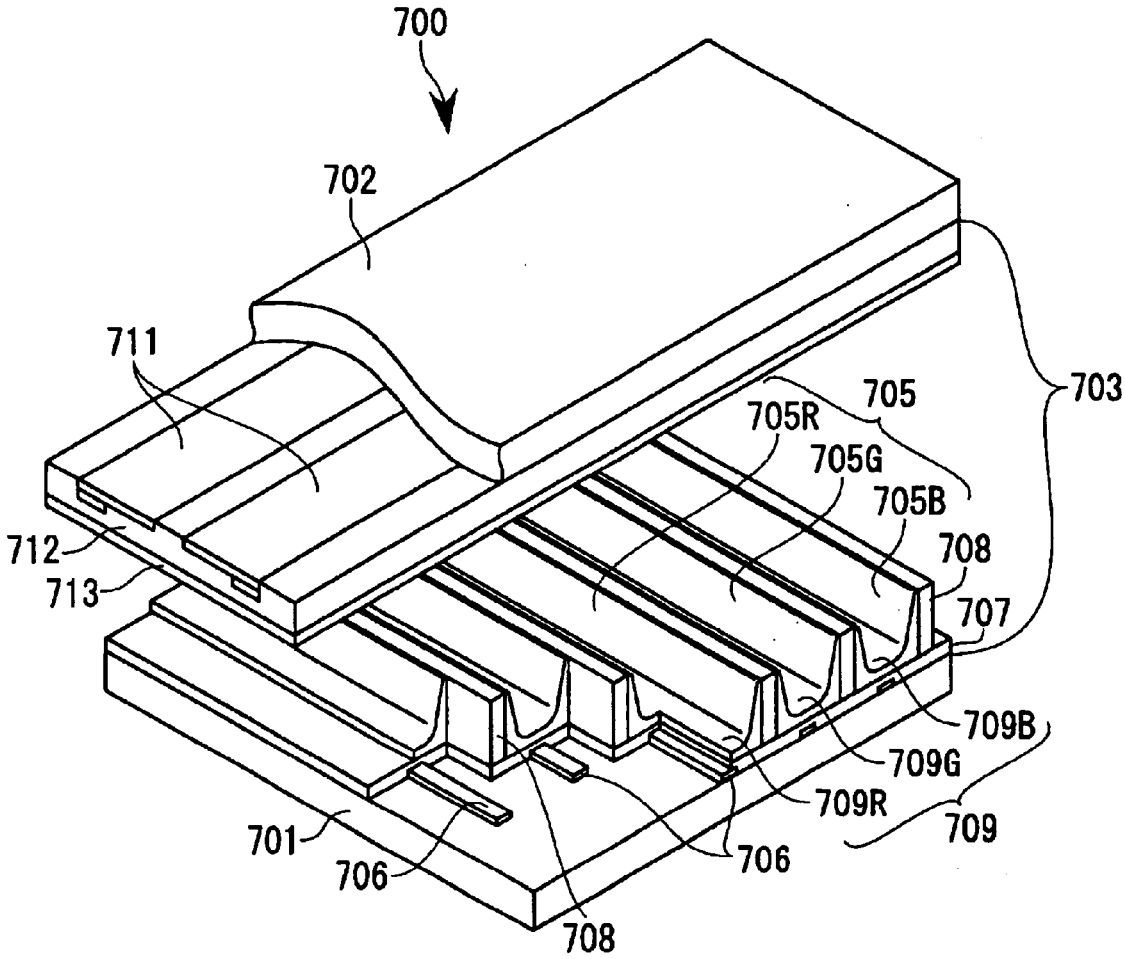
FIG. 29 is an exploded perspective view f an important portion of a display device which is a plasma display panel (PDP) device.

FIG. 29 is an exploded perspective view showing an important part of the plasma type of display device (PDP device, simply referred to as a display device 700). In the figure, the display device 700 is shown in a partly cut away state.

This display device 700 is made up of a first substrate 701 and a second substrate 702 which are disposed to lie opposite to each other, as well as a discharge display part 703 which is formed therebetween. The discharge display part 703 is constituted by a plurality of discharging chambers 705. Among these plurality of discharging chambers 705, the three chambers 705 of a red discharging chamber 705R, a green discharging chamber 705G, and a blue discharging chamber 705B are disposed as a set to make one pixel.

On an upper surface of the first substrate 701, there are formed address electrodes 706 in a stripe form at a given distance from one another. A dielectric layer 707 is formed to cover these address electrodes 706 and the upper surface of the first substrate 701. On the dielectric layer 707, there are vertically disposed partition walls 708 which are positioned between respective address electrodes 707 in a manner to lie along the respective address electrodes 706. Some of these partition walls 708 extend on both widthwise sides of the address electrodes 706 and others (not illustrated) extend at right angles to the address electrodes 706.

The regions which are partitioned by these partition walls 708 form the discharge chambers 705.

Inside the discharge chambers 705, there are disposed fluorescent bodies 709. The fluorescent bodies 709 emit luminescent light of any one of red (R), green (G) and blue (B). At the bottom of the red discharging chamber 705R, there are disposed red fluorescent bodies 709R, at the bottom of the green discharging chamber 705G, there are disposed green fluorescent bodies 709R, and at the bottom of the blue discharging chamber 705B, there are disposed blue fluorescent bodies 709B, respectively.

On the lower side of the second substrate 702 as seen in the figure, there are formed a plurality of display electrodes 711 in a direction crossing the address electrodes 706 at right angles at a predetermined distance from one another. In a manner to cover them, there are formed a dielectric layer 712 and a protection film 713 which is made of MgO, or the like.

The first substrate 701 and the second substrate 702 are oppositely adhered to each other in a state in which the address electrodes 706 and the display electrodes 711 cross each other at right angles. The address electrodes 706 and the display electrodes 711 are connected to an AC power source (not illustrated).

By charging electricity to each of the electrodes 706, 711, the fluorescent bodies 709 are caused to emit light through excitation, whereby color display becomes possible.

In this embodiment, the address electrodes 706, the display electrodes 711, and the fluorescent bodies 709 can be formed by using the liquid droplet ejection apparatus 1 as shown in FIG. 1. A description will now be made about an example of steps for manufacturing the address electrodes 706 on the first substrate 701.

In this case, the following steps are performed in a state in which the first substrate 126 is placed on the setting table of the liquid droplet ejection apparatus 1.

First, by means of the function liquid droplet ejection head 10, the liquid material (function liquid) containing therein a material for forming the conductive film wiring is caused to hit the address electrode forming region as the function liquid droplet. This liquid material is prepared as the electrically conductive film wiring (wiring formed by electrically conductive film) by dispersing electrically conductive fine particles of metals, or the like, into a dispersion medium. As the electrically conductive fine particles, there are used metallic fine particles containing therein gold, silver, copper, palladium, nickel, or the like, or an electrically conductive polymer, or the like.

Once all of the address electrode forming regions in which the liquid material is scheduled to be filled have been filled therewith, the liquid material after ejection is dried to evaporate the dispersion medium contained in the liquid material, whereby the address electrodes 706 are formed.

An example of the address electrodes 706 has been given hereinabove, but the display electrodes 711 and the fluorescent bodies 709 can also be formed by the above-described steps.

In forming the display electrodes 711, a liquid material (function liquid) containing therein the electrically conductive wiring forming material is caused to hit the display electrode forming region, in a similar manner as in the case of the address electrodes 706.

In forming the fluorescent bodies 709, on the other hand, a liquid material containing therein a fluorescent material (a kind of liquid material according to this invention) corresponding to each of the colors (R, G, B) is ejected from the three function liquid droplet ejection heads 10 to thereby cause them to hit the discharge chambers 705 of corresponding colors.

Figure 30:
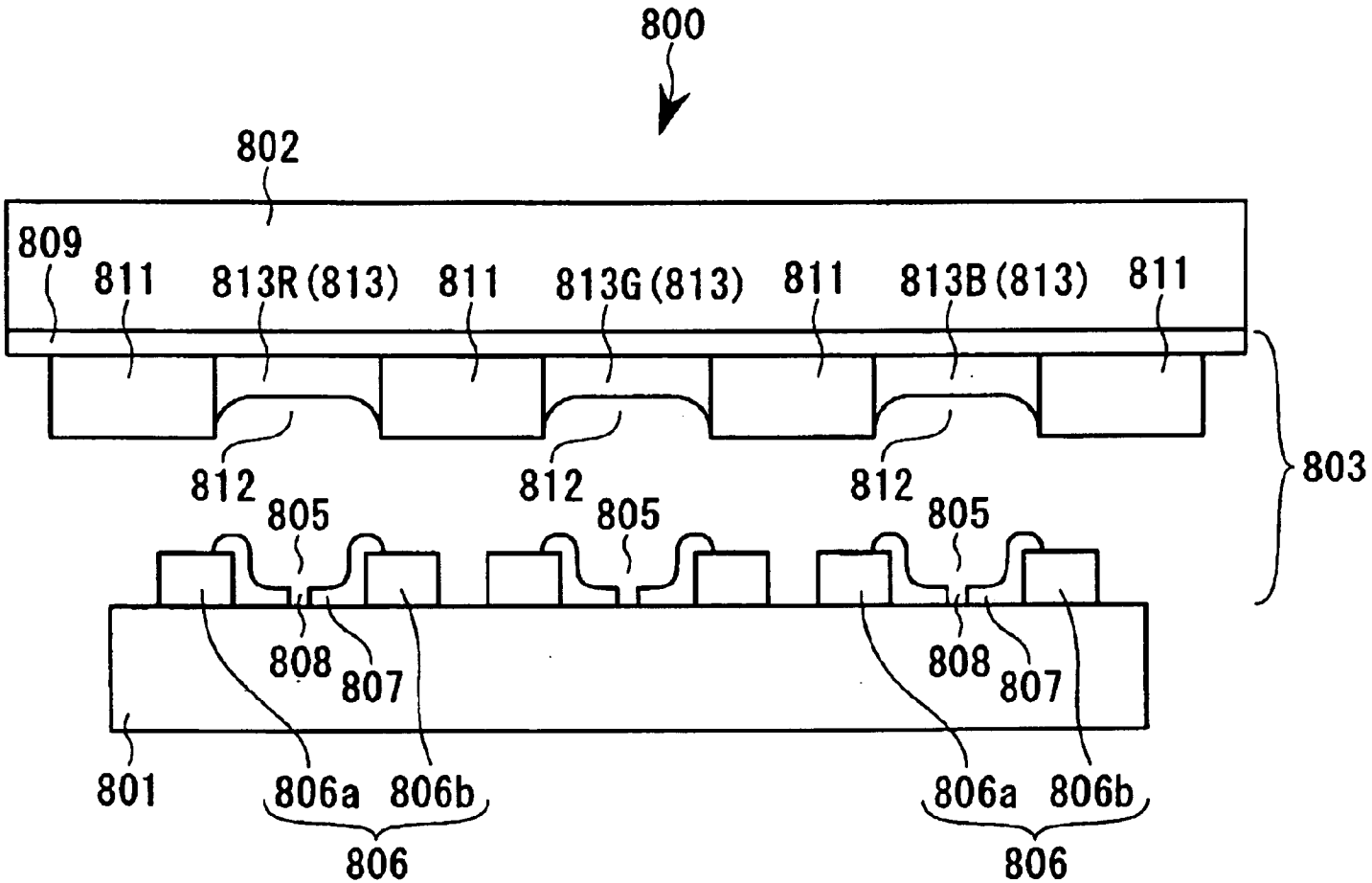
FIG. 30 is a sectional view of an important portion of the display device which is an electron emission device (FED device)

FIG. 30 is a sectional view showing an important part of the electron emission device (FED device, hereinafter simply referred to as a display device 800) which is a kind of the display device according to this invention. In the figure, the display device 800 is partly shown in section.

The display device 800 is made up of a first substrate 801 and a second substrate 802 which are disposed opposite to each other, as well as a field emission display part 803 which is formed therebetween. The field emission display part 803 is constituted by a plurality of electron emission parts 805 which are arranged in matrix.

On an upper surface of the first substrate 801, there are formed first element electrodes 806*a* and second electrodes 806*b* which constitute cathode electrodes 806, in a manner to cross each other at right angles. In each of the portions partitioned by the first element electrodes 806*a* and the second element electrodes 806*b*, there is formed an element film 807 with a gap 808 formed therein. In other words, a plurality of electron emission parts 805 are constituted by the first element electrodes 806*a*, the second element electrodes 806*b* and the element film 807. The element film 807 is made, e.g., of palladium oxide (PdO), or the like, and the gap 808 is formed by the work called forming, or the like, after having formed the element film 807.

On a lower surface of the second substrate 802, there is formed an anode electrode 809 which lies opposite to the cathode electrode 806. On a lower surface of the anode electrode 809, there is formed a lattice-shaped bank part 811. In each of the downward-looking openings 812 enclosed by the bank part 811, there is disposed a fluorescent body 813 in a manner to correspond to the electron emission part 805. The fluorescent body 813 emits light of either red (R), green (G), and blue (B). In each of the opening parts 812, there is disposed a red fluorescent body 813R, a green fluorescent body 813G, and a blue fluorescent body 813B in a predetermined pattern.

The first substrate 801 and the second substrate 802 constituted as described above are adhered to each other at a very small gap therebetween. In this display device 800, the electrons to be emitted from the first element electrode 806*a* and the second element electrode 806*b* as the cathode are excited and caused to emit light through the element film (gap 808) 807 by causing them to hit the fluorescent body 813 formed on the anode electrode 809 which is the anode. Color display is thus possible.

In this case, too, as in the other embodiments, the first element electrode 806*a*, the second element electrode 806*b*, and the anode electrode 809 can be formed by using the liquid droplet ejection apparatus 1. Fluorescent bodies 813R, 813G, 813B of each color can be formed by using the liquid droplet ejection apparatus 1.

In this case, like in the other cases, the first element 806*a*, the second element electrode 807, the electrically conductive film 807, and the anode electrode 809 can be formed by using the liquid droplet ejection apparatus 1, and the fluorescent body 813R, 813G, 813B of each color can be formed by using the liquid droplet ejection apparatus 1.

Figure 31A:
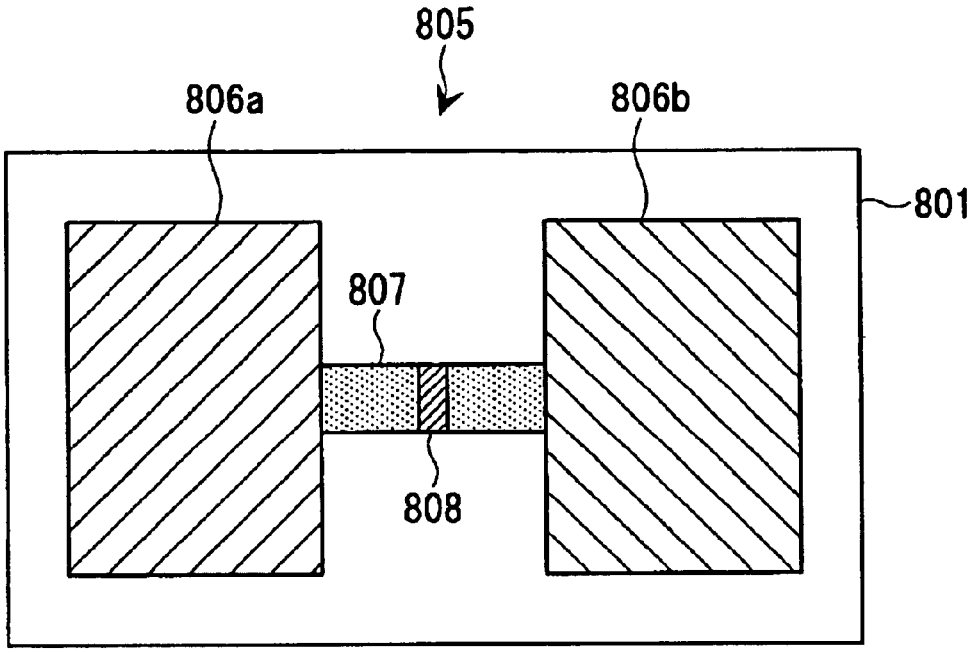
FIG. 31A is a plan view around an electron emission part of the display device and FIG. 31B is a plan view thereof.
Figure 31B:
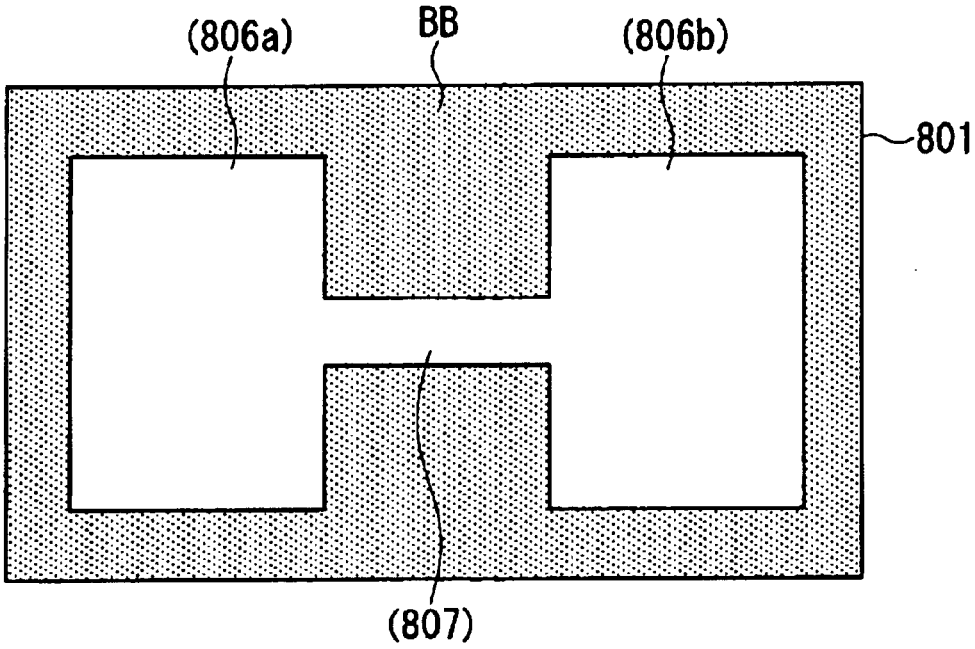

The first element electrode 806*a*, the second element electrode 806*b* and the electrically conductive film 807 has a flat shape as shown in FIG. 31A. In forming this film, as shown in FIG. 31B, the bank portion BB is formed by photolithographic method while leaving the portions in which the first element electrode 806*a*, the second element electrode 806*b*, and the electrically conductive film 807 are formed. Then, in the groove portion which is constituted by the bank portion BB, the first element electrode 806*a* and the second element electrode 806*b* are formed (by ink jet method with the liquid droplet ejection apparatus 1). After the solvent is dried and the film is formed, the electrically conductive film 807 is formed (in the ink jet method with the liquid droplet ejection apparatus 1). Then, after having formed the electrically conductive film 807, the bank portion BB is removed (peeling by the processing called ashing), and the process proceeds to the above-described forming processing. In the same manner as in the above-described organic EL device, it is preferable to perform the liquid-affinity processing to the first substrate 801 and the second substrate 802, as well as the liquid-repellency processing to the bank portion 811, BB.

As the other electro-optic apparatus, there can be considered an apparatus for forming a metallic wire, for forming a lens, for forming a resist, for forming a light diffusion body, as well as an apparatus for forming a preparation.

In other words, the above-described liquid droplet ejection apparatus 1 can be applied to various function liquids and cleaning liquids by adequately eliminating or removing static electricity. Therefore, it can be used in manufacturing various kinds of electro-optic devices at a higher efficiency.

As described hereinabove, according to the liquid droplet ejection apparatus of this invention, the static electricity to be generated in the connection tubes of resin make can be eliminated efficiently by means of the grounding means. In other words, those movable portions of the connection tubes which are likely to generate static electricity are brought into contact with the static elimination sheet over the entire length of the movable portions so as to eliminate the generated static electricity. The non-moving portions of the connection tubes are provided with couplings for static elimination at a predetermined interval so as to appropriately eliminate the static electricity. In addition, the ordinary coupling can also be utilized as the static elimination coupling by making it in an electrically conductive material. It is, therefore, not necessary to provide separate members, whereby the apparatus can be minimized in the occupying space and simplified in construction.

Still furthermore, in the method of manufacturing an electro-optic device, an electro-optic device, and an electronic apparatus according to this invention, the above-described liquid droplet ejection apparatus is used in manufacturing. Therefore, it is less likely to be subject to the effect of the static electricity, and efficient manufacturing is thus possible.

The entire disclosure of Japanese Patent Application Nos. 2002-288867 filed Oct. 1, 2002 and 2003-297221 filed Aug. 21, 2003 are incorporated by reference.

What is claimed is:

1. A liquid droplet ejection apparatus having:

a function liquid droplet ejection head which is mounted on a movable table and which ejects a function liquid droplet toward a workpiece in a manner synchronized with scanning by said movable table; and function liquid supply means for supplying said function liquid droplet ejection head with a function liquid, wherein said function liquid supply means comprises:

a function liquid tank for supplying a function liquid;

a connection tube of resin make for connecting said function liquid droplet ejection head and said function liquid tank together;

a flexible rack member fixed at one end thereof to said movable table and at an opposite end thereof to an apparatus frame so as to support thereon said connection tube in a manner movable to follow the scanning of said function liquid droplet ejection head; and a grounding means disposed over an entire length of said flexible rack member, for static elimination of said connection tube through said apparatus frame by keeping contact with said connection tube.

2. The apparatus according to claim 1, wherein said grounding means is constituted by a static elimination sheet disposed on that supporting surface of said flexible rack member which supports said connection tube.

3. The apparatus according to claim 2, wherein said static elimination sheet is disposed over an entire length of the supporting surface of said flexible rack member.

4. The apparatus according to claim 2, wherein said static elimination sheet comprises a nap for static elimination provided on that surface of said static elimination sheet which comes into contact with said connection tube.

5. The apparatus according to claim 1, further comprising an electrically conductive coupling for grounding said connection tube through said apparatus frame, said coupling being interposed in a non-moving portion except for that part of the connection tube which is supported on said flexible rack member.

6. The apparatus according to claim 5, wherein said coupling is disposed in a plurality of numbers in the non-moving portion of the connecting tube at a predetermined interval.

7. The liquid droplet ejection apparatus according to claim 5, wherein grounding of said coupling is made through said apparatus frame by means of an electrically conductive coupling supporting fixture.

8. A method of manufacturing an electro-optic device comprising forming a film forming part with a function liquid droplet ejected from the function liquid droplet ejection head toward the workpiece by using the liquid droplet ejection apparatus as set forth in claim 5.

9. An electro-optic device manufactured by the method of manufacturing an electro-optic device as set forth in claim 8.

10. An electro-optic device comprising a film forming part formed by a function liquid droplet ejected from the function liquid droplet ejection head toward the workpiece by using the liquid droplet ejection apparatus as set forth in claim 5.

11. An electronic apparatus having mounted thereon the electro-optic device as set forth in claim 10.

12. A liquid droplet ejection apparatus having: a function liquid droplet ejection head; a wiping unit for wiping away a nozzle surface of said function liquid droplet ejection head by moving relative to said function liquid droplet ejection head; a movable table for mounting thereon said wiping unit so as to move said wiping unit relative to said function liquid droplet ejection head; and cleaning liquid supply means for supplying said wiping unit with a cleaning liquid for wiping, wherein said cleaning liquid supply means comprises:

a cleaning liquid tank for feeding a cleaning liquid;

a connection tube of resin make for connecting said cleaning liquid tank and said wiping unit together;

a flexible rack member fixed at one end thereof to said movable table and at an opposite end thereof to an apparatus frame so as to support thereon said connection tube in a manner movable to follow the movement of said wiping unit; and a grounding means disposed over an entire length of said flexible rack member, for static elimination of said connection tube through said apparatus frame by keeping contact with said connection tube.

13. The apparatus according to claim 12, wherein said grounding means is constituted by a static elimination sheet disposed on that supporting surface of said flexible rack member which supports said connection tube.

14. The apparatus according to claim 13, wherein said static elimination sheet is disposed over an entire length of the supporting surface of said flexible rack member.

15. The apparatus according to claim 13, wherein said static elimination sheet comprises a nap for static elimination provided on that surface of said static elimination sheet which comes into contact with said connection tube.

16. The apparatus according to claim 12, further comprising an electrically conductive coupling for grounding said connection tube through said apparatus frame, said coupling being interposed in a non-moving portion except for that part of the connection tube which is supported on said flexible rack member.

17. The apparatus according to claim 16, wherein said coupling is disposed in a plurality of numbers in the non-moving portion of the connecting tube at a predetermined interval.

18. The liquid droplet ejection apparatus according to claim 16, wherein grounding of said coupling is made through said apparatus frame by means of an electrically conductive coupling supporting fixture.

19. A method of manufacturing an electro-optic device comprising forming a film forming part with a function liquid droplet ejected from the function liquid droplet ejection head toward the workpiece by using the liquid droplet ejection apparatus as set forth in claim 16.

20. An electro-optic device manufactured by the method of manufacturing an electro-optic device as set forth in claim 19.

21. An electro-optic device comprising a film forming part formed by a function liquid droplet ejected from the function liquid droplet ejection head toward the workpiece by using the liquid droplet ejection apparatus as set forth in claim 16.

22. An electronic apparatus having mounted thereon the electro-optic device as set forth in claim 21.

* * * * *